US007131204B2

(12) United States Patent
Brown et al.

(10) Patent No.: US 7,131,204 B2
(45) Date of Patent: Nov. 7, 2006

(54) UTILITY KNIFE WITH ACTUATOR FOR MOVING BLADE CARRIER AND FOR RELEASING BLADE THEREFROM, AND RELATED METHOD

(75) Inventors: Donald A. Brown, Sterling, MA (US); Kevin Fleury, Feeding Hill, MA (US); William B. Korb, Melrose, CT (US); Norman LeBlanc, Harrisburg, NC (US); Steven R. Levine, Mooresville, NC (US); Corey M. Talbot, Hebron, CT (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/985,124

(22) Filed: Nov. 9, 2004

(65) Prior Publication Data

US 2005/0188541 A1 Sep. 1, 2005

Related U.S. Application Data

(60) Provisional application No. 60/518,689, filed on Nov. 10, 2003, provisional application No. 60/518,690, filed on Nov. 10, 2003.

(51) Int. Cl.
*B26B 1/08* (2006.01)

(52) U.S. Cl. ..... 30/162; 30/335

(58) Field of Classification Search ..... 30/162, 30/335, 329, 151
See application file for complete search history.

(56) References Cited

U.S. PATENT DOCUMENTS 3,107,426 A 10/1963 Robinson, Jr.
3,577,637 A * 5/1971 Braginetz ..... 30/162
3,708,881 A 1/1973 Bennett
3,879,847 A 4/1975 Roll
4,242,795 A 1/1981 Rollband et al.
4,621,425 A 11/1986 Stoutenberg
4,663,845 A 5/1987 Weimann
4,813,132 A 3/1989 Castelluzzo
4,930,218 A 6/1990 Jacoff
5,025,558 A 6/1991 Gilbert
5,042,154 A 8/1991 Gilbert
5,099,578 A 3/1992 Jan
5,509,205 A 4/1996 Ragland, III
5,797,188 A 8/1998 Gilbert
5,862,596 A 1/1999 Chung (Continued)

*Primary Examiner*—Hwei-Siu Payer
(74) *Attorney, Agent, or Firm*—McCarter & English, LLP

(57) ABSTRACT

A utility knife has a blade carrier defining a blade support surface movably mounted in a housing between retracted and extended positions. A catch is mounted on the blade carrier and is movable between a first position engagable with a blade seated on the blade carrier and substantially preventing the blade from moving relative to the blade carrier, and a second position spaced away from the blade located on the blade carrier and permitting removal of the blade from the blade carrier. An actuator is mounted on the blade carrier and is operable to move the blade carrier between the retracted and extended positions to, in turn, move a blade located on the blade carrier between retracted and extended positions, and move the catch between the first and second positions to release a blade from the blade carrier. The housing has a nose portion that defines the blade aperture and is made of a more wear-resistant material than the other portions of the housing. A sheet material spare blade holder is mounted within the housing and defines a fold, a support portion located on one side of the fold, and a biased retaining portion located on the other side of the fold for receiving spare blades therebetween.

60 Claims, 20 Drawing Sheets

U.S. PATENT DOCUMENTS

| | | | | |
|---|---|---|---|---|
| 5,864,952 | A | 2/1999 | Chung | |
| 5,940,970 | A | 8/1999 | D'Ambro, Sr. et al. | |
| 6,161,290 | A | 12/2000 | Takamasa | |
| 6,163,963 | A | 12/2000 | Huang | |
| 6,192,589 | B1 * | 2/2001 | Martone et al. | 30/125 |
| 6,249,975 | B1 * | 6/2001 | Lin | 30/162 |
| 6,317,985 | B1 | 11/2001 | Huang | |
| 6,324,763 | B1 * | 12/2001 | Lee | 30/162 |
| 6,330,749 | B1 | 12/2001 | Khachatoorian et al. | |
| 6,349,473 | B1 | 2/2002 | Schmidt | |
| 6,357,120 | B1 * | 3/2002 | Khachatoorian et al. | 30/162 |
| 6,374,497 | B1 * | 4/2002 | Sun | 30/162 |
| 6,415,514 | B1 | 7/2002 | Chun | |
| 6,438,849 | B1 | 8/2002 | Wonderley | |
| 6,487,778 | B1 | 12/2002 | Gringer et al. | |
| 6,513,246 | B1 * | 2/2003 | Ping | 30/125 |
| 6,553,674 | B1 * | 4/2003 | Budrow | 30/162 |
| 6,574,872 | B1 | 6/2003 | Roberts et al. | |
| 6,742,261 | B1 * | 6/2004 | Ho | 30/162 |
| 6,886,257 | B1 * | 5/2005 | Chih | 30/125 |
| 2004/0163261 | A1 * | 8/2004 | Lin | 30/162 |

* cited by examiner

UTILITY KNIFE WITH ACTUATOR FOR MOVING BLADE CARRIER AND FOR RELEASING BLADE THEREFROM, AND RELATED METHOD

CROSS-REFERENCE TO RELATED APPLICATIONS

This patent application claims priority on U.S. Provisional Patent Application Ser. No. 60/518,689, entitled "UTILITY KNIFE", filed on Nov. 10, 2003, and U.S. Provisional Patent Application Ser. No. 60/518,690, entitled "UTILITY KNIFE WITH ACTUATOR FOR MOVING BLADE CARRIER AND FOR RELEASING BLADE THEREFROM, AND RELATED METHOD", filed on Nov. 10, 2003, each of which is hereby expressly incorporated by reference as part of the present disclosure. This patent application also discloses subject matter similar to that disclosed in the following co-pending patent applications, each of which also is hereby expressly incorporated by reference as part of the present disclosure: U.S. Design Application Ser. No. 29/193,538, filed on Nov. 10, 2003, entitled "UTILITY KNIFE"; U.S. Design Application Ser. No. 29/193,524, filed on Nov. 10, 2003, entitled "UTILITY KNIFE"; U.S. Design Application Ser. No. 29/193,586, filed on Nov. 11, 2003, entitled "UTILITY KNIFE"; and U.S. Design Application Ser. No. 29/193,585, filed on Nov. 11, 2003, entitled "UTILITY KNIFE".

FIELD OF THE INVENTION

The present invention relates to utility knives, and more particularly, to utility knives that include a blade carrier for selectively moving utility knife blades between retracted and extended positions, and an actuator for moving the blade carrier and for releasing blades from the blade carrier through a blade aperture.

BACKGROUND INFORMATION

Utility knives generally include a handle and at least one replaceable blade. Because such blades are known to become worn or damaged, utility knife handles generally include provisions to allow a blade to be removed from the handle, so that the blade may be reversed in the handle (in order to provide a new cutting edge for the knife) and/or replaced by another blade.

In the case of many utility knives, the removal of a worn or damaged blade requires that the handle first be opened to gain access to the internal cavity inside the handle. However, because it is sometimes inconvenient to open the handle, some utility knives provide mechanisms that allow a blade to be removed without any need for first opening the handle. Such mechanisms often make use of a releasable catch that engages the replaceable blade within the handle, along with a manually operable mechanism for causing the releasable catch to disengage from the blade. Most of these mechanisms allow a worn or damaged blade to be removed through a blade opening at the front end of the handle.

These and other types of mechanisms require an additional actuator, such as a button and associated hardware mounted in a side wall of the housing, that is depressed in order to cause the releasable catch to disengage from the blade. Thus, such retractable blade utility knives require at least two actuators, one to move the blade and blade carrier between retracted and extended positions, and another to release the blade when located in an extended position. In addition, notwithstanding the availability of such mechanisms, there are still occasions in which a handle must be opened, for example, in order to retrieve a spare blade that may be stored inside the handle or to perform repair or maintenance inside the handle. Unfortunately, upon opening the handle, many of the above-mentioned mechanisms can fall out and become separated from the handle, thereby rendering the mechanism unusable.

As with blades, handles also can become worn or damaged due to demanding operating conditions, such as in the course of regular use in cutting asphalt roof tiles. Consequently, utility knife handles are sometimes formed of metal (e.g., steel) to provide durability. However, even knives with steel handles continue to become worn and/or damaged frequently, on account of such operating conditions.

Accordingly, it is an object of the present invention to overcome one or more of the above-described drawbacks or disadvantages of the prior art.

SUMMARY OF THE INVENTION

In accordance with a first aspect, the present invention is directed to a utility knife comprising a housing, and a blade carrier movably mounted on the housing and including a blade supporting surface for supporting a blade. The blade carrier is movable between a retracted position with at least a substantial portion of the blade retracted in the housing, and at least one extended position with at least a portion of the blade extending outwardly of the housing. A catch is movable between a first position engagable with a blade located on the blade carrier and substantially preventing relative movement of the blade and blade carrier, and a second position spaced away from a blade located on the blade carrier and permitting removal of the blade from the blade carrier. An actuator is mounted on the blade carrier and operable to (1) move the blade carrier between the retracted and extended positions to, in turn, move a blade located on the blade carrier between retracted and extended positions, and (2) move the catch between the first and second positions to release a blade from the blade carrier.

In one embodiment of the present invention, the actuator is pivotally mounted on the blade carrier and is movable laterally to move the catch between the first and second positions. In another embodiment of the present invention, the actuator is rotatably mounted on the blade carrier and is rotatable to move the catch between the first and second positions.

In some embodiments of the present invention, the housing includes a first portion formed of a first material, and a second portion formed of a second material and coupled to the first portion. The second portion defines a nose, and a blade aperture for receiving a blade therethrough when the blade carrier is located in the extended position, and for removing a blade therethrough when the catch is located in the second position. In one embodiment of the present invention, the second material is more wear-resistant than the first material.

In some embodiments of the present invention, the utility knife includes a spare blade holder formed of sheet material, such as spring steel. The sheet material spare blade holder defines a mounting portion connectable to the housing for supporting the spare blade holder thereon, a blade support portion, a first fold located between the mounting and blade support portions, a blade retaining portion overlying the blade support portion and biased toward the blade support portion, and a second fold formed between the blade support and blade retaining portions. A plurality of spare blades are slidably receivable between the blade support and blade retaining portions.

In some embodiments of the present invention, the utility knife further comprises an axially-elongated surface defining an axially-elongated slot, and a fastener coupled between the blade carrier and slot for guiding movement of the blade carrier between retracted and extended positions. In one embodiment of the present invention, the axially-elongated surface is defined by a bar fixedly secured to an interior surface of the housing and forming therein the axially-elongated slot. In this embodiment, the blade carrier may define an axially-elongated boss received within the slot for guiding movement of the carrier through the slot.

In some embodiments of the present invention, the actuator defines a first manually-engagable surface for moving the actuator between the retracted and extended positions, and a second manually-engagable surface for moving the actuator to, in turn, move the catch. In one embodiment, the first manually-engagable surface is an upper surface of the actuator, and the second manually-engagable surface is a side surface of the actuator. If desired, the actuator may define a visible marking or like means on the second manually-engagable surface for identifying a location at which force may be applied to move the actuator and, in turn, move the catch from the first toward the second position.

In accordance with another aspect, the present invention is directed to a utility knife comprising a housing defining a blade aperture, and first means for carrying a blade between retracted and extended positions. The utility knife further includes second means movable between a first position for substantially preventing relative movement of the first means and a blade, and a second position for releasing the blade and permitting removal of the blade through the blade aperture of the housing. The utility knife further includes third means mounted on the first means for (1) moving the first means between retracted and extended positions to, in turn, move a blade mounted on the first means between retracted and extended positions, and (2) moving the second means in a direction from the first toward the second position to permit removal of the blade through the blade aperture of the housing.

In one embodiment of the present invention, the first means is a blade carrier, the second means is a catch, and the third means is an actuator. Preferably, the actuator is either (1) movable laterally for moving the second means between the first and second positions, or (2) rotatable for moving the second means between the first and second positions.

In accordance with another aspect, the present invention is directed to a method of carrying a blade in a utility knife and releasing a blade therefrom. The method comprises the following steps:

(i) providing a utility knife having a housing defining a blade aperture, a blade carrier movably mounted on the housing, a catch movably mounted on the blade carrier, and an actuator mounted on the blade carrier and operable to move the blade carrier and catch;

(ii) mounting a blade on the blade carrier;

(iii) moving the actuator between retracted and extended positions to, in turn, move the blade mounted on the blade carrier between retracted and extended positions; and (iv) moving the actuator to, in turn, move the catch between a first position substantially preventing relative movement of the blade carrier and blade, and a second position releasing the blade and permitting the blade to be removed through the blade aperture.

In one embodiment of the present invention, the method further comprises the steps of:

moving the actuator and blade carrier to an extended position;

with the blade carrier in the extended position, moving the actuator and, in turn, moving the catch from the first to the second position; and with the catch located in the second position, removing the blade from the blade carrier and through the blade aperture.

Preferably, the method further comprises the step of either pivoting the actuator laterally to move the catch from the first to the second position, or rotating the actuator to move the catch from the first to the second position.

One advantage of the present invention is that a single actuator can be used to both move the blade carrier and blade between retracted and extended positions, and to move the catch to, in turn, release the blade from the blade carrier. As a result, the utility knives of the present invention may avoid the need for a separate button or like actuator for releasing a blade, and the associated hardware that may be required to secure such extra button or like actuator to a side wall of the housing.

Another advantage of one currently preferred embodiment of the present invention is that the nose portion of the housing is formed of a more wear-resistant material than other portions of the housing, thus providing a more durable and long-lasting housing. Yet another advantage of the currently preferred embodiments of the present invention is that the bar or like member defining an elongated slot both guides the blade carrier between the retracted and extended positions, and secures the blade carrier to the housing to thereby prevent the blade carrier and components mounted thereto from falling out upon opening the housing.

These and other advantages will become more readily apparent in view of the following detailed description of the currently preferred embodiments of the present invention and accompanying drawings.

DETAILED DESCRIPTION OF PREFERRED EMBODIMENTS

Figure 1:
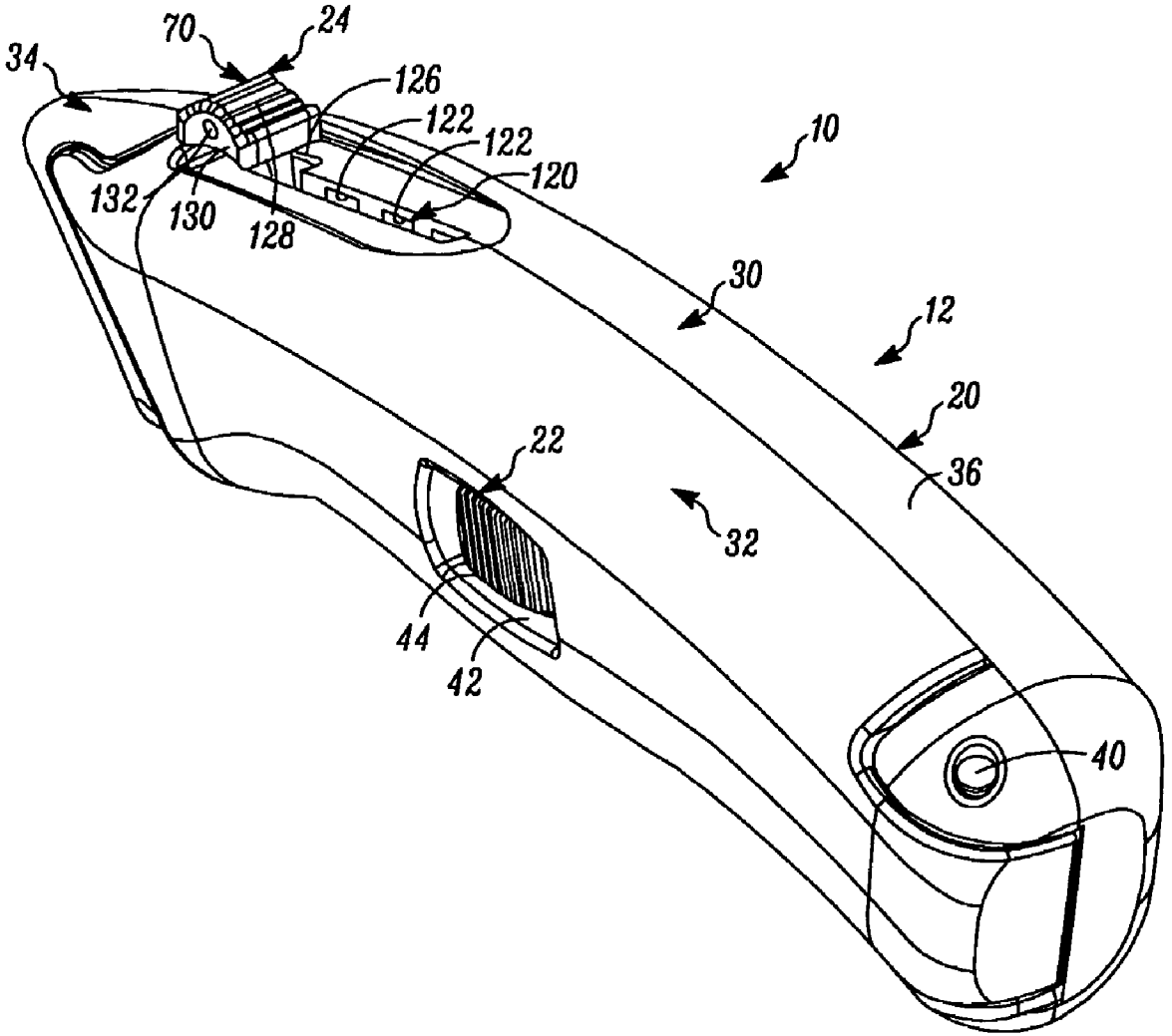
FIG. 1 is a rear perspective view of a first embodiment of a utility knife of the present invention.
Figure 8:
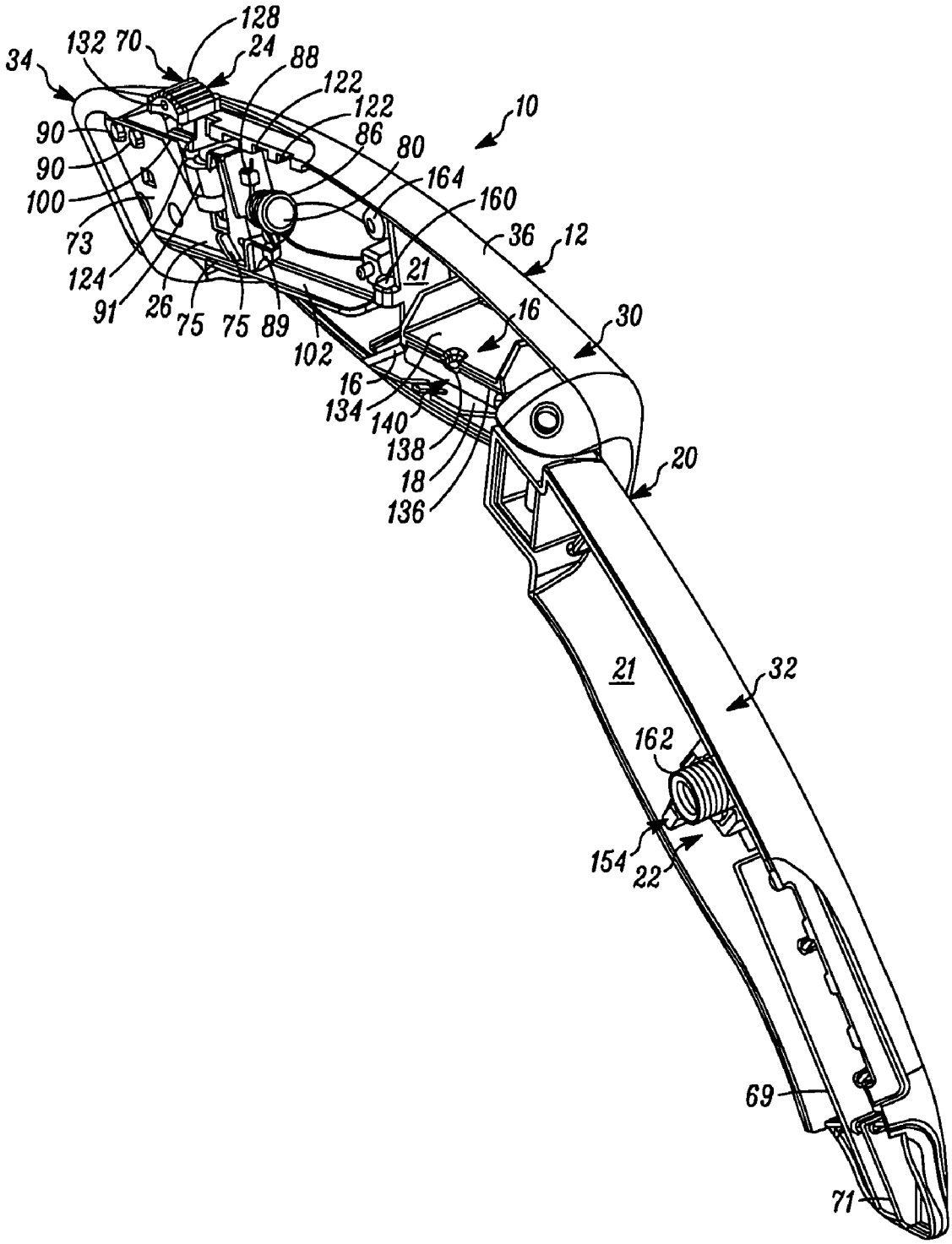
FIG. 8 is a rear, upper perspective view of the utility knife of FIG. 1 shown fully opened and with some parts removed for clarity.
Figure 9:
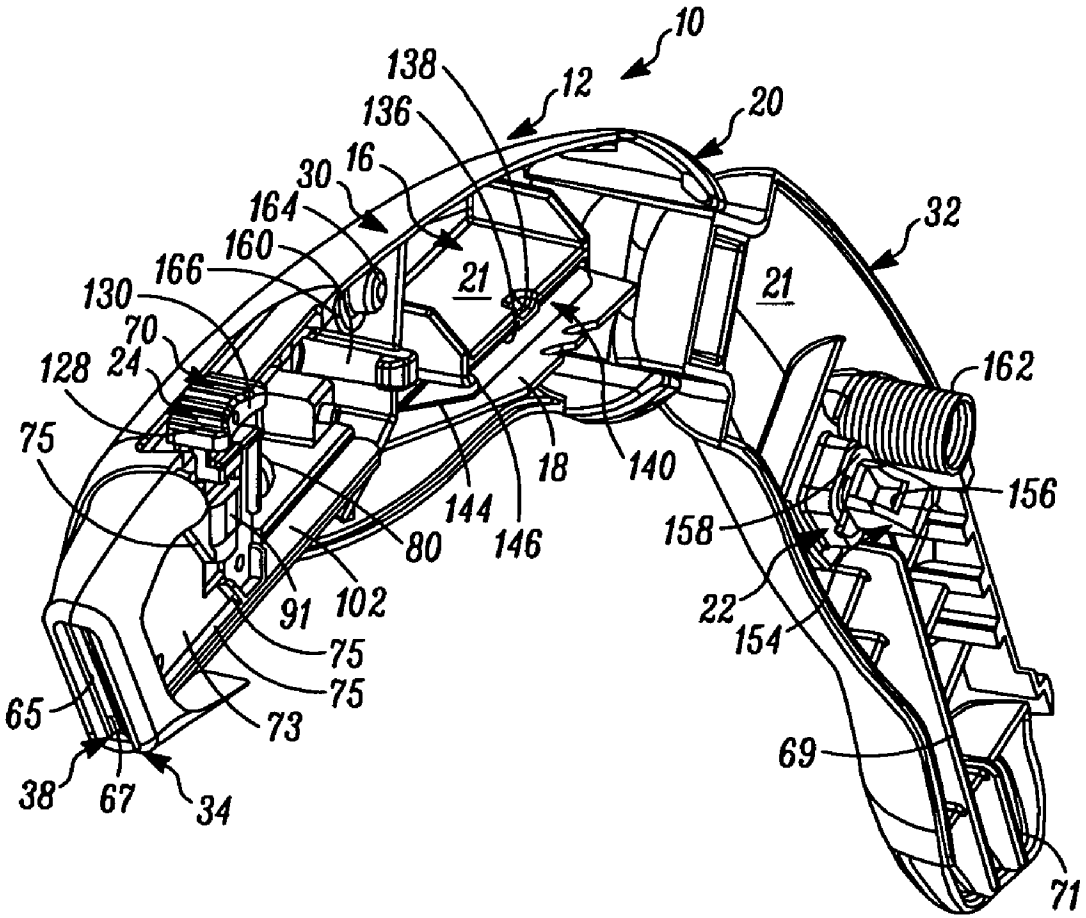
FIG. 9 is a front, upper perspective view of the utility knife of FIG. 1 shown fully opened and with some parts removed for clarity.
Figure 10:
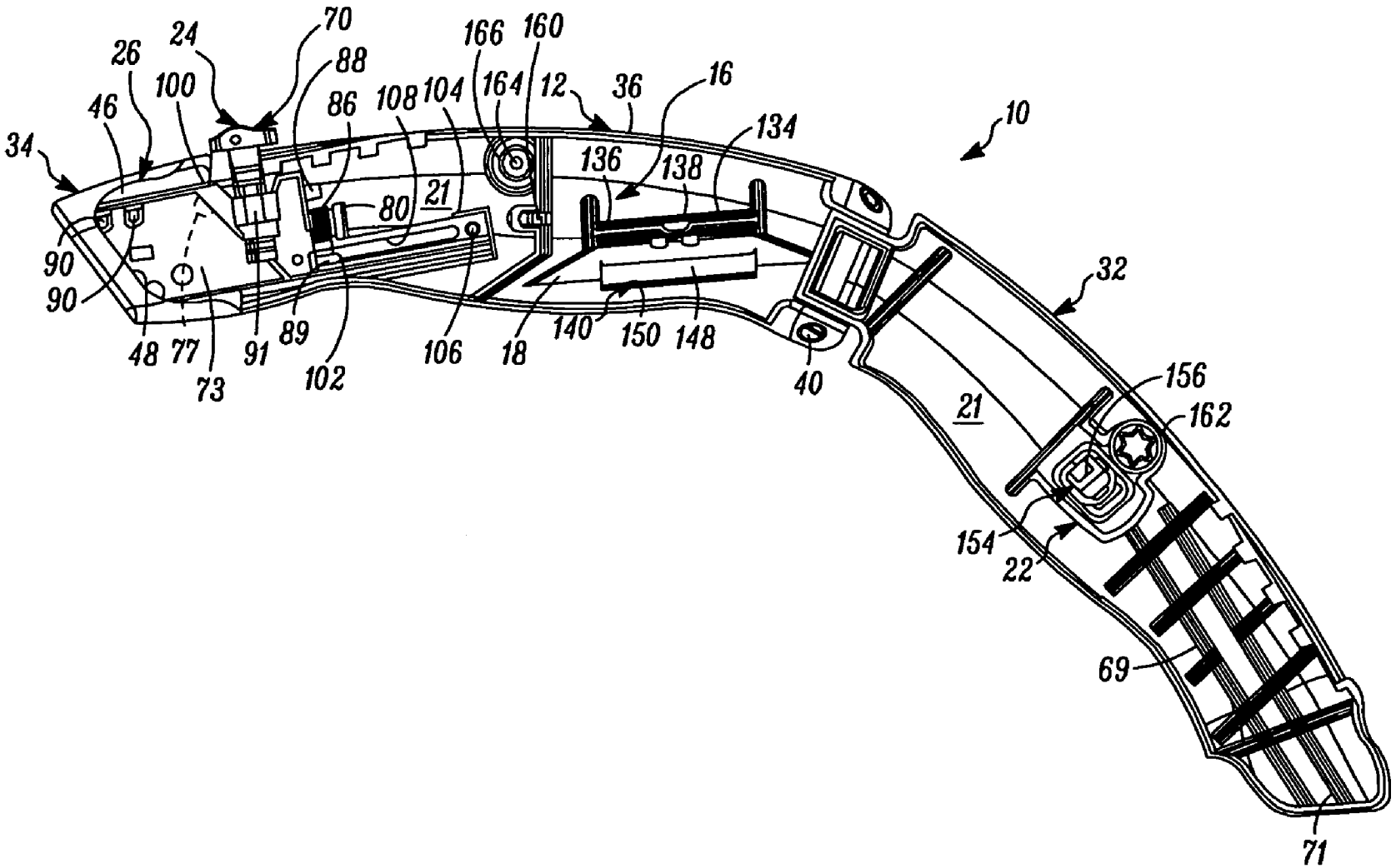
FIG. 10 is a side elevational view of the utility knife of FIG. 1 shown fully opened.
Figure 11:
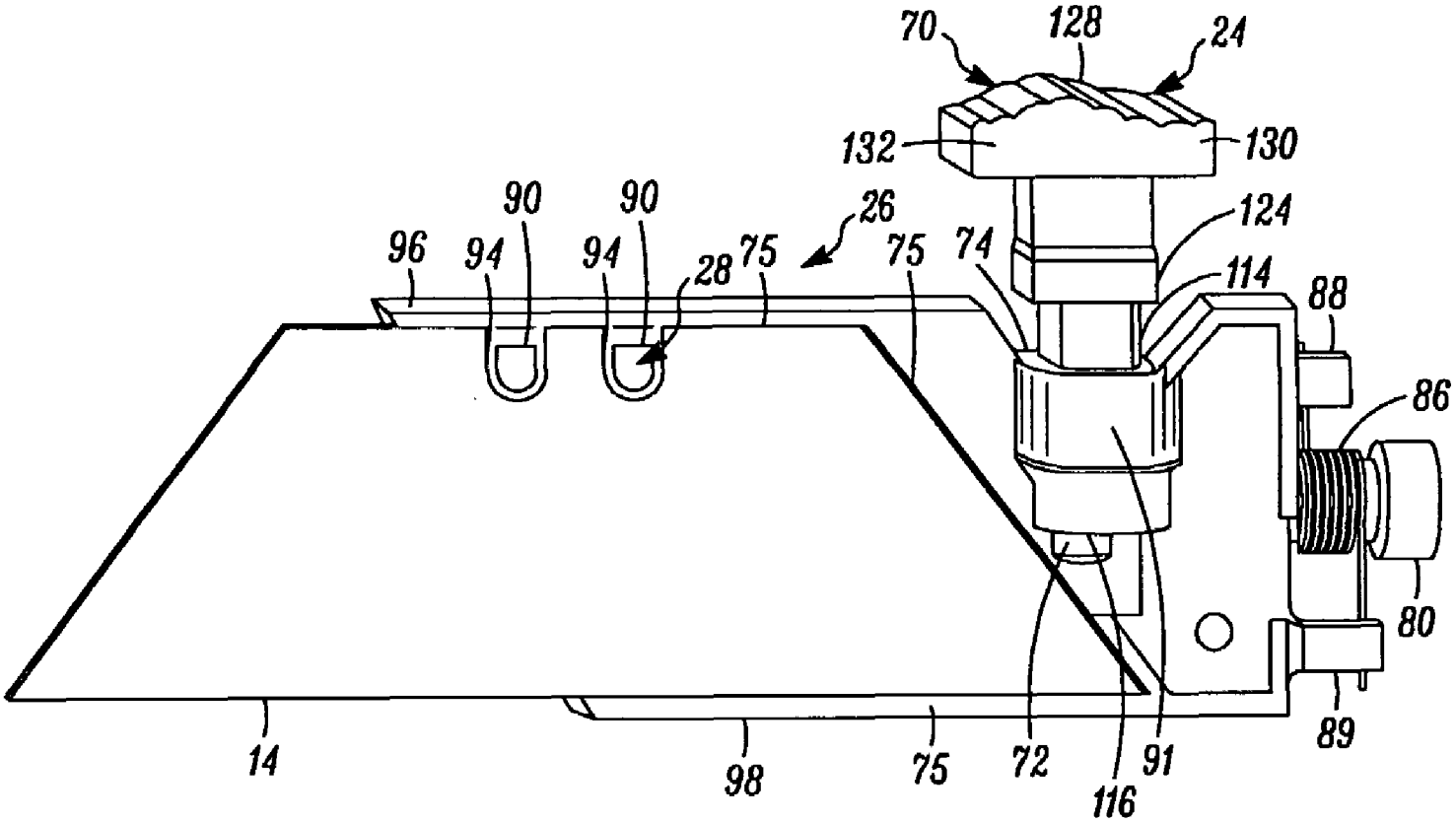
FIG. 11 is a side perspective view of the blade carrier, actuator and catch of the utility knife of FIG. 1.

In FIG. 1, a utility knife embodying the present invention is indicated generally by the reference numeral 10. The utility knife 10 includes a handle 12, a blade 14 (FIGS. 11–13) and a spare blade holder assembly 16 for storing spare blades 18 (FIGS. 8–10). The handle 12 includes a housing 20 defining a substantially internal cavity 21 (FIGS. 8–10), a mechanism 22 for releasably holding opposing portions of the housing 20 together, and an actuator 24 for moving the blade 14 between retracted and extended positions, and for releasing the blade 14 from the housing 20.

Figure 12:
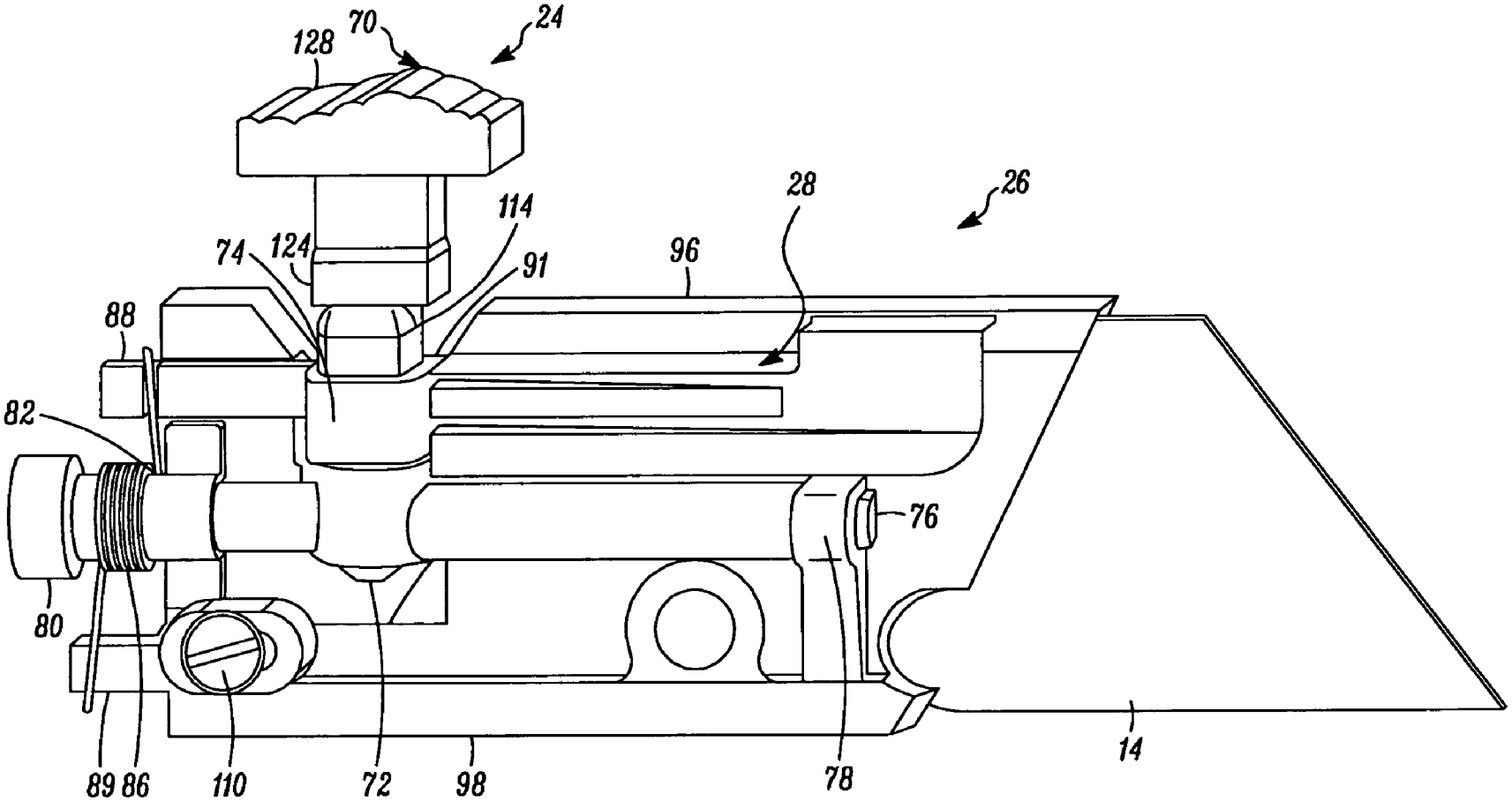
FIG. 12 is an opposite side perspective view of the blade carrier, actuator and catch of the utility knife of FIG. 1.

As shown in FIGS. 8–13, the blade carrier 26 supports thereon the blade 14 and is movably mounted within the housing 20 to move the blade between a retracted position with the blade received or concealed within the housing, and at least one, and preferably a plurality of, extended positions with the cutting edge of the blade extending outwardly of the housing. As shown in FIG. 12, a catch 28 is movably mounted on the blade carrier 26 between a first position engagable with the blade 14 located on the blade carrier and substantially preventing relative movement of the blade and blade carrier, and a second position spaced away from a blade 14 permitting removal of the blade from the blade carrier 26. The actuator 24 is mounted on the blade carrier 26 and is operable to (1) move the blade carrier between the retracted and extended positions to, in turn, move the blade 14 located on the blade carrier between retracted and extended positions, and (2) move the catch 28 between the first and second positions to release the blade 14 from the blade carrier 26.

Figure 2:
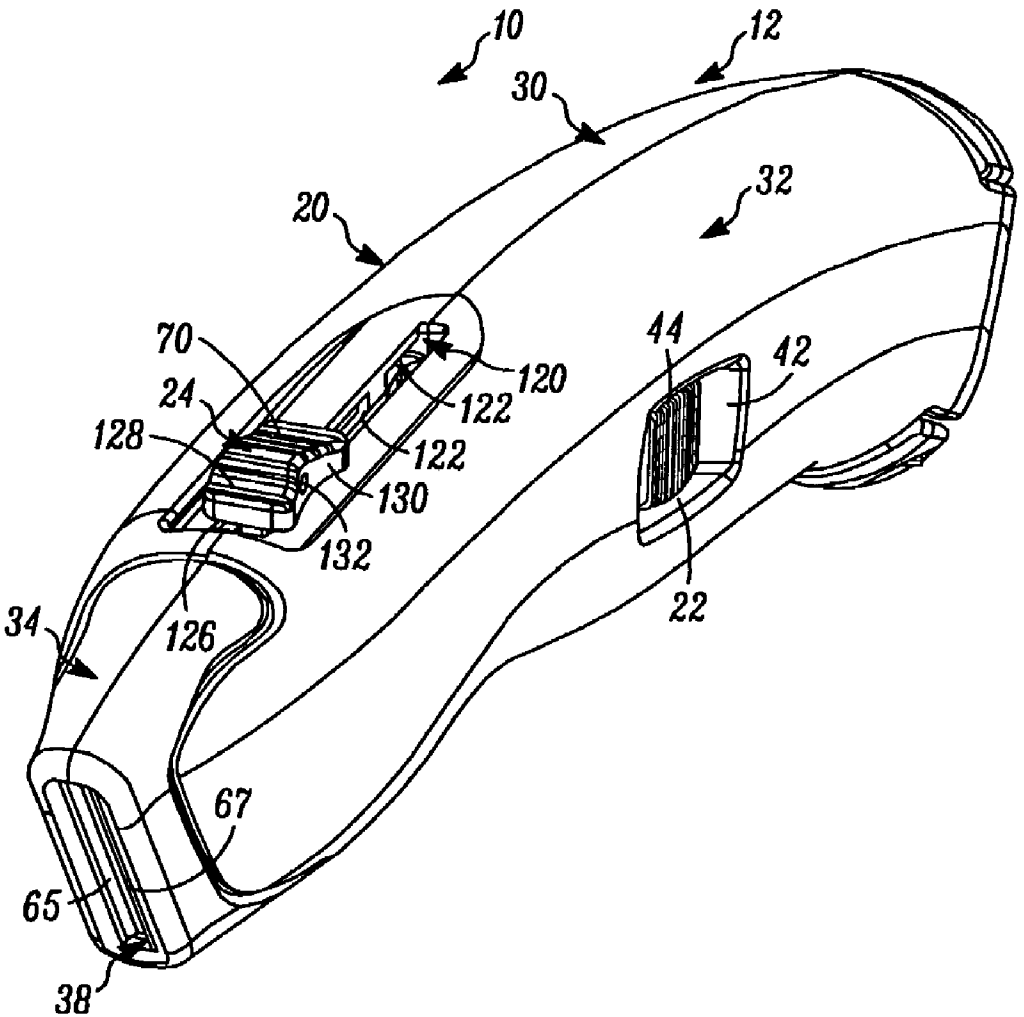
FIG. 2 is a front perspective view of the utility knife of FIG. 1.
Figure 3:
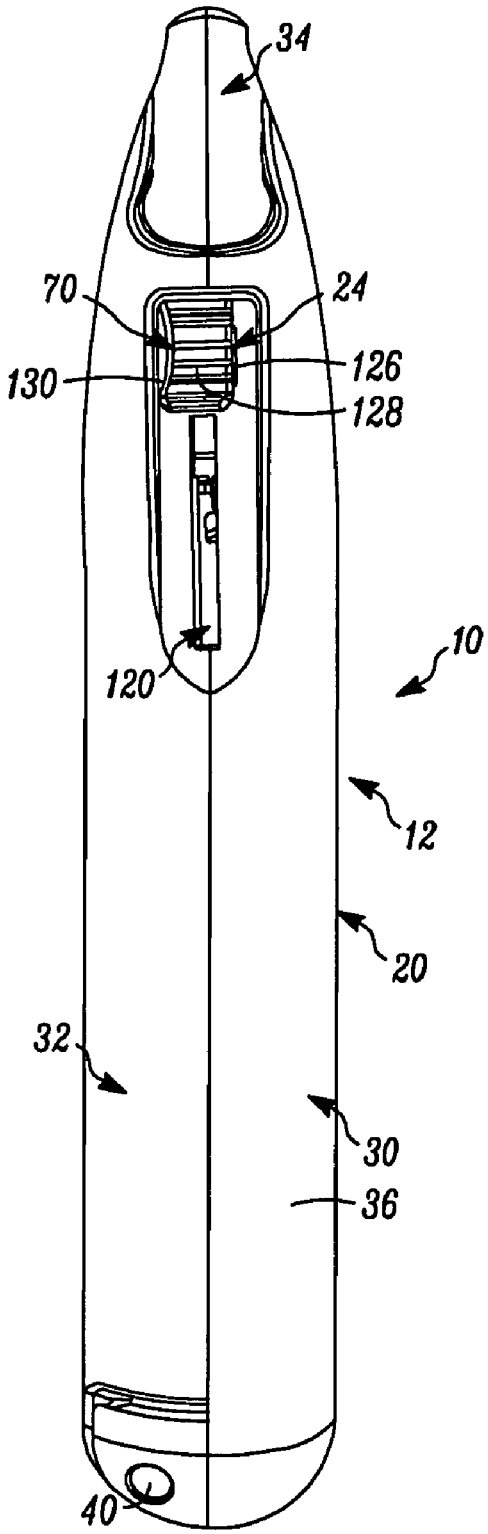
FIG. 3 is a top plan view of the utility knife if FIG. 1.

As shown typically in FIGS. 1 and 2, the housing 20 is formed of two separate portions 30, 32. The first portion 30 is made up of a nose portion 34 and a rear portion 36 disposed rearwardly of the nose portion 34. As shown in FIG. 2, the nose portion 34 defines a blade opening 38 at a first end of the handle 12 to receive therethrough the blade 14. The rear portion 36 is, to some extent, a mirror image of the second housing portion 32 and is pivotably connected thereto by, for example, a fastener (e.g., shown as a pin 40) disposed toward a rear end of the housing 20.

In this particular embodiment, the nose and rear portions 34, 36 are formed separately and thereafter fixedly attached to one another, for example, but not limited to, by fastening, welding, bonding, forcing, or gluing the two portions together. It should be understood that the nose and rear portions 34, 36 also may be formed in an integral fashion, for example, as a single piece, or still further, in a build-up fashion, for example, by metal injection molding or over molding, where one portion is formed and concurrently joined to another portion which was previously formed.

The second housing portion 32 defines an opening or recess 42 that receives a manually operable button portion 44 of the mechanism 22 for releasably fastening the two portions 30, 32 of the housing 20. The housing portions 30, 32, 34 may be formed in any manner, for example, but not limited to, by casting, machining, welding, and/or combinations thereof, and of any suitable material, for example, but not limited to, metal, plastic, and/or combinations thereof. Moreover, there is no requirement that the portions 30, 32, 34 be made of the same material. For example, if the portions 30, 32, 34 are formed of metal, they may or may not be formed of the same metal. Indeed, in some preferred embodiments, the nose portion 34 is formed of a metal (e.g., stainless steel) that is more wear resistant than the metal(s) forming the second housing portion 32 and the rear portion 36 of the first housing portion 30 (e.g., aluminum), in order to increase the durability of the nose. This has the advantage that selected portion(s) of the housing 20 can be made more wear resistant than other portions, to improve the durability where needed, without the need to make the entire housing more wear resistant. Because higher wear resistant materials are often more expensive than less wear resistant materials, this approach provides an opportunity to improve durability, where needed, at lesser cost than would result from using higher wear resistant materials throughout the entire housing 20.

Figure 10A:
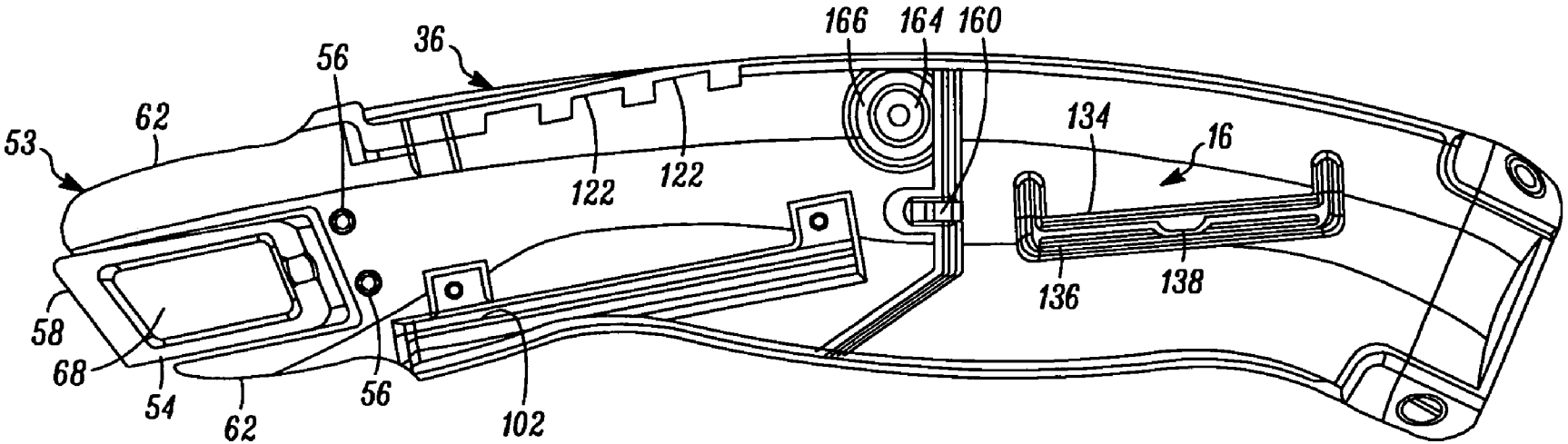
FIG. 10A is a side elevational view of a rear housing portion of the utility knife of FIG. 1 prior to attachment of the nose portion thereto.
Figure 10B:
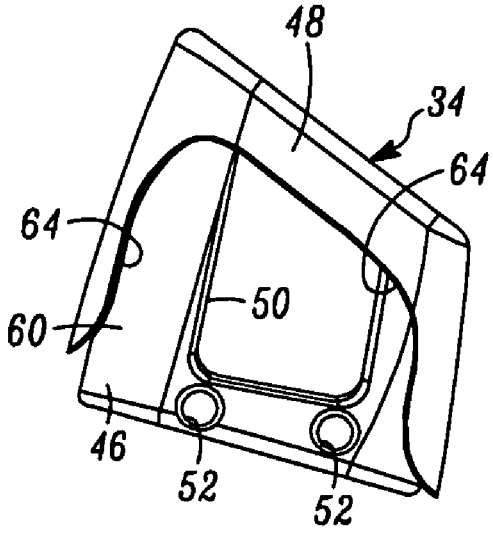
FIG. 10B is a side elevational view of the nose portion of the housing of the utility knife of FIG. 1 prior to attachment to the rear housing portion of FIG. 10A.
Figure 10C:
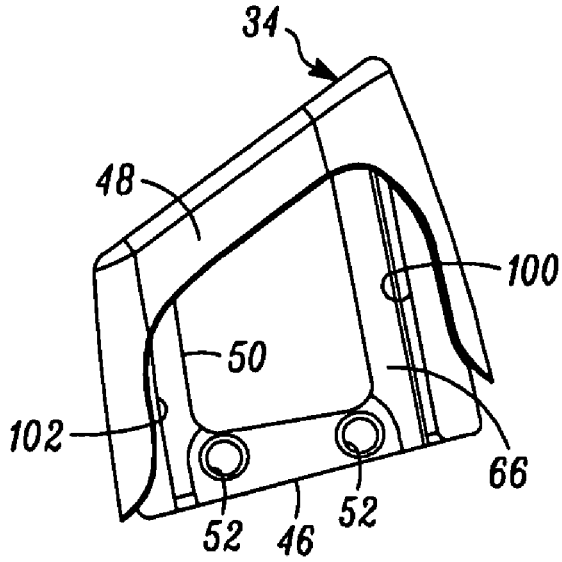
FIG. 10C is an opposite side elevational view of the nose portion of FIG. 10B.

Referring to FIGS. 10–10C, the nose portion 34 of the housing 20 includes a support portion 46 and a generally u-shaped outer portion 48 extending therefrom. The support portion 46 defines a first aperture 50 and two second apertures 52 spaced rearwardly of the first aperture 50. As shown in FIG. 10A, the rear portion 36 of the housing 20 defines on its front end an attachment portion 53 including a first boss 54 that is shaped to be received within the first aperture 50 of the nose 34, and two second bosses 56 that are received within the second apertures 52 of the nose. The boss 54 of the attachment portion 53 defines on its forward end a flange 58 that extends outwardly therefrom. As shown in FIG. 10B, the support portion 46 of the nose 34 defines an outer support surface 60 that is shaped to contact and support thereon a peripheral surface 62 formed on the attachment portion 53 of the rear portion 36 of the housing (FIG. 10A). The outer support surface 60 of the nose 34 is spaced inwardly relative to the adjacent u-shaped portion 48 to thereby define an approximately u-shaped groove 64 therebetween. The forward portion of the groove 64 is dimensioned to receive therein the forward flange 58 of the boss 54 of the attachment portion 53 of the housing (FIG. 10A), and the lateral portions of the groove 64 are dimensioned to receive the peripheral edge 62 of the attachment portion 53 of the housing.

In order to attach the nose 34 to the rear portion 36 of the housing, the forward flange 58 is first inserted into the forward edge of the groove 64 of the nose. Then, the remaining portions of the outer support surface 60 of the nose and peripheral surface 62 of the attachment portion 53 are brought into contact with each other such that the second bosses 56 of the attachment portion are received within the corresponding apertures 52 of the nose. The forward flange 58 of the attachment portion 53 mechanically interlocks the nose 34 to the attachment portion of the housing. If desired, the second bosses 56 of the attachment portion 53 may be threaded to receive nuts or other fasteners (not shown), or may define rivets or like deformable portions to deform the ends of the bosses extending through the apertures to, in turn, fixedly secure the nose to the attachment portion. In addition, or alternatively, the nose can be welded, glued, or otherwise fixedly secured to the attachment portion as described above, or in accordance with any of numerous mechanisms and/or methods for attachment that are currently or later become known.

In the illustrated embodiment, the nose 34 is formed of a 300 series stainless steel, such as 316 stainless steel, and is formed by metal injection molding ("MIM"). The MIM nose 34 is assembled to the rear portion 36 in the manner described above, i.e., the ends of the second bosses 56 are peened or otherwise deformed laterally over the edges of the corresponding apertures 52, and an adhesive, such as a one-part cyanoacrylate, is applied to the interface of the nose 34 and rear portion 36 adjacent to the second bosses 56 and corresponding apertures 52, to fixedly secure the nose 34 to the rear portion 36. As may be recognized by those of ordinary skill in the pertinent art based on the teachings herein, these materials, methods of forming, and methods of assembly are only exemplary, and numerous other materials, methods of forming, and/or methods of assembly, that are currently known, or that later become known, equally may be used.

As shown in FIG. 10C, the nose 34 further defines an inner support surface 66 extending about the periphery of the first aperture 50, and as shown in FIG. 10A, the attachment portion 53 defines an underlying recess 68 within the first boss 54. The inner support surface 66 supports the blade carrier 26 when located in a fully extended position.

Figure 5:
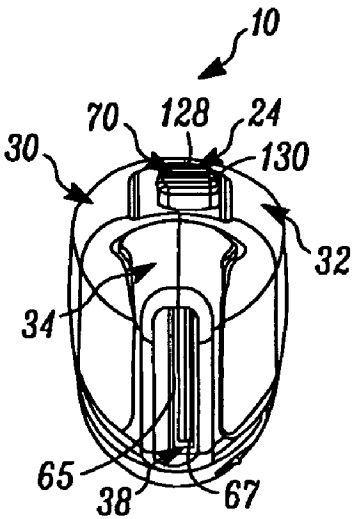
FIG. 5 is a front elevational view of the utility knife of FIG. 1.
Figure 4:
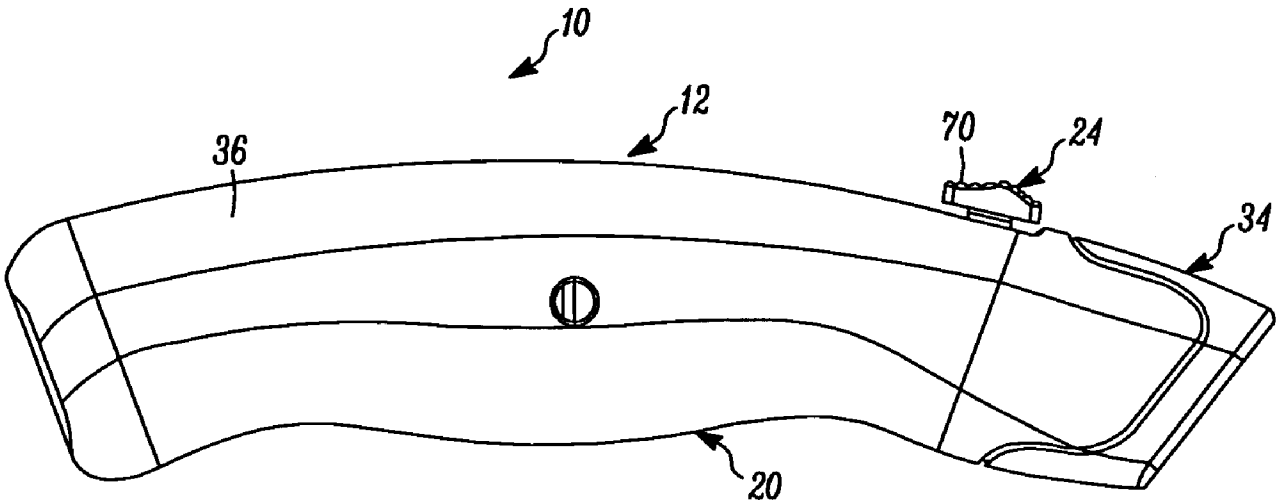
FIG. 4 is a side elevational view of the utility knife of FIG. 1.
Figure 7:
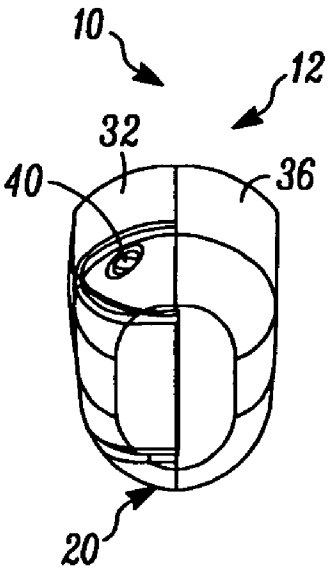
FIG. 7 is a rear elevational view of the utility knife of FIG. 1.
Figure 6:
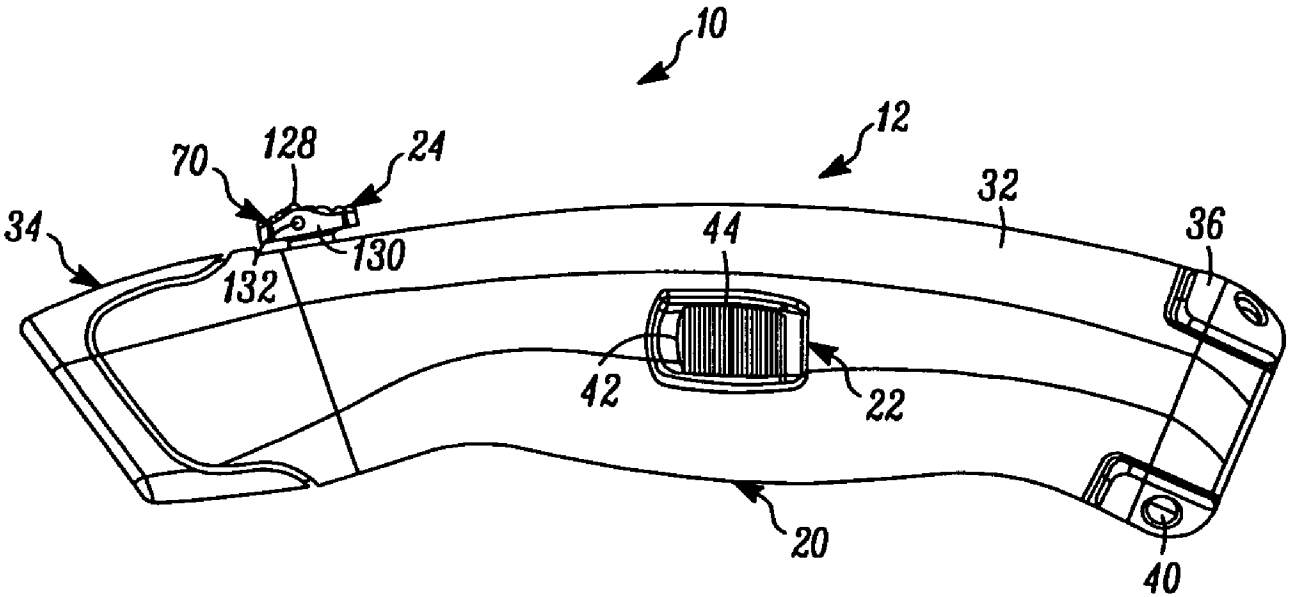
FIG. 6 is another side elevational view of the utility knife opposite the side elevational view of FIG. 4.

The u-shaped outer portion 48 of the nose 34 defines spaced apart opposing surfaces 65, 67 (FIG. 5) that define the blade opening 38 therebetween. The opposing surfaces 65, 67 each may be substantially planar and substantially parallel to one another, although this is not required. The two surfaces 65, 67 are separated by a distance that is selected, for example, to be large enough to allow the blade 14 to pass therebetween, yet small enough that the surfaces 65, 67 provide some lateral stability for the blade 14 during use, e.g., during cutting, sticking, etc. As shown in FIGS. 8–10, the second housing portion 32 defines ribs 69, 71 that extend laterally therefrom along the path of blade movement to provide further lateral stability during use, and the blade carrier 26 defines a substantially planar blade supporting surface 73 that is spaced apart from, and faces the ribs 69, 71 when the blade carrier is located in extended positions. When the housing 20 is in a closed state, the ribs 69, 71 are spaced laterally from the blade supporting surface 73 of the blade carrier 26 a distance that is sufficiently wide to allow the blade 14 to fit therebetween, yet sufficiently narrow to prevent lateral movement of the blade 14 away from the blade supporting surface 73. As shown typically in FIG. 11, a peripheral rim 75 extends about three sides of the blade supporting surface 73 and is raised relative thereto for receiving the blade 14. As can be seen, the rim 75 substantially conforms to the peripheral shape of the corresponding surfaces of the blade 14 seated therein to properly seat and orient the blade on the blade carrier. As shown in broken lines in FIG. 10, the blade carrier 26 may include one or more blade-retaining tabs 77 that extend over the rim 75 and are spaced laterally from the blade supporting surface 70 to further prevent movement of the blade off of the blade supporting surface, particularly when the blade is subjected to substantial laterally-directed or other such forces during use.

Figure 13:
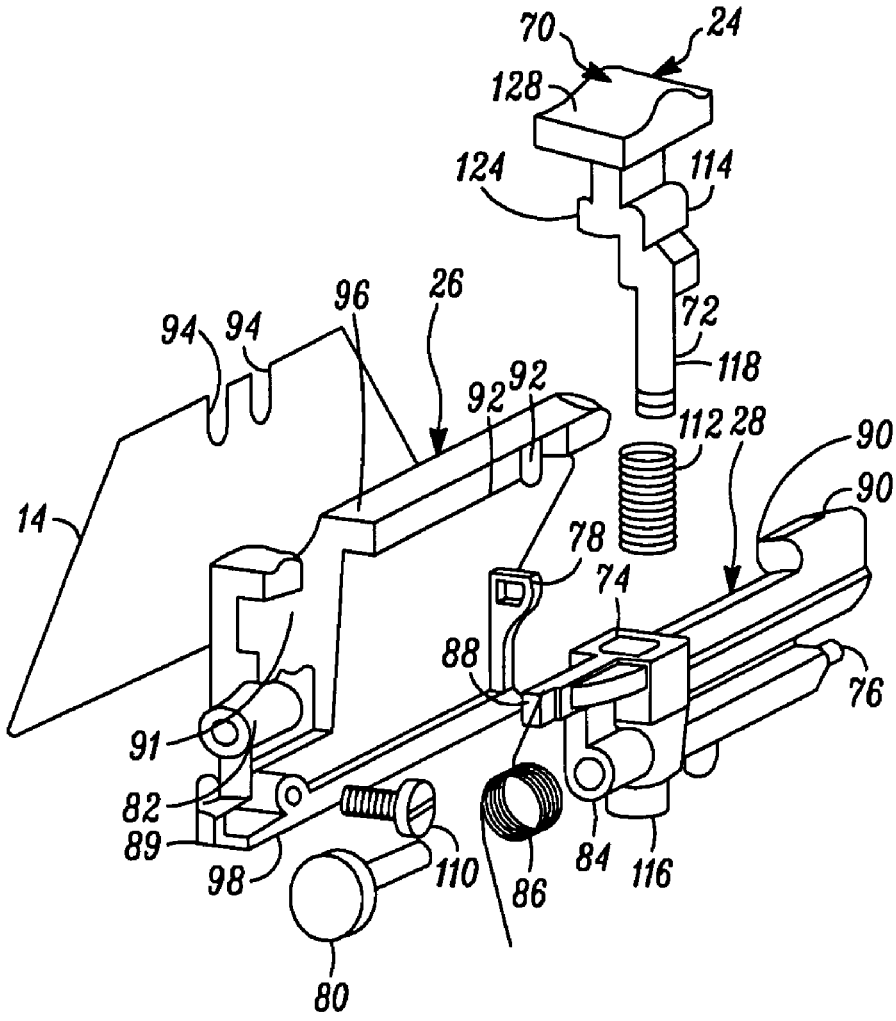
FIG. 13 is a perspective, exploded view of the blade carrier, actuator and catch of the utility knife of FIG. 1.
Figure 14:
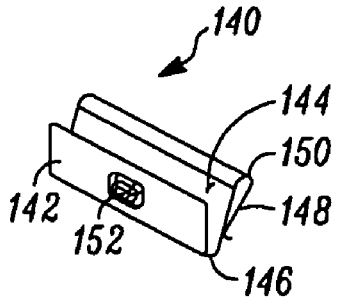
FIG. 14 is a perspective view of the spare blade holder of the utility knife of FIG. 1.
Figure 15:
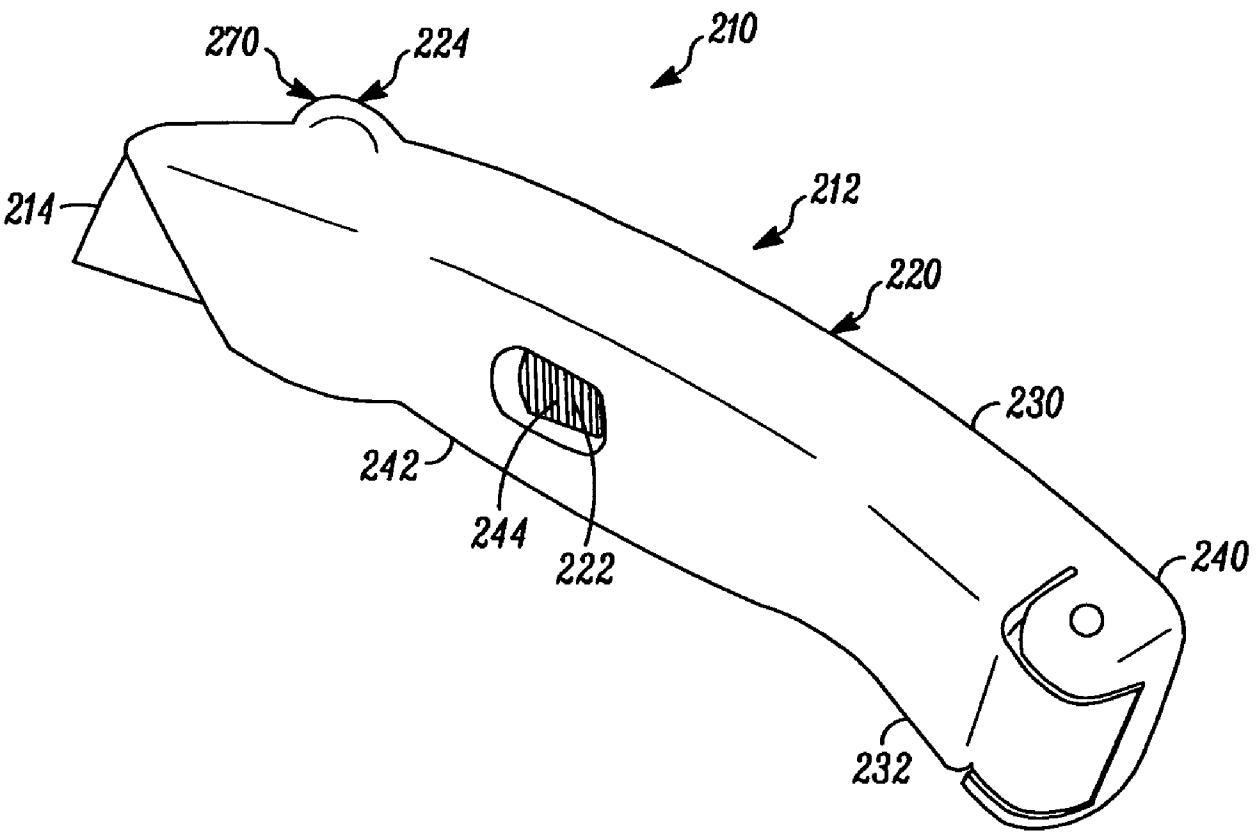
FIG. 15 is a perspective view of a second embodiment of a utility knife of the present invention.

As shown best in FIGS. 11–14, the actuator 24 includes a manually engageable button 70, and a shaft 72 extending downwardly from the button and received within a lug 74 of the blade catch 28 (FIGS. 12 and 13). As shown best in FIGS. 12 and 13, the blade catch 28 is pivotally mounted at one end by a pin 76 received within a first lug 78 formed on the back side of the blade carrier 26, and is pivotally mounted at the other end by a fastener 80 received within a second lug 82 formed on the back side of the blade carrier 26. As shown in FIG. 13, the catch 28 defines an aperture 84 for receiving the end of the fastener 80. The fastener 80 may be threadedly received, press fit, or otherwise fixedly secured within the recess 84. A torsion spring 86 engages a first spring-engaging portion 88 formed on one end of the catch 28, and a second spring-engaging portion 89 formed on the blade carrier 26 to bias the catch inwardly toward the blade carrier. The blade carrier 26 defines a stop 91 to engage the lug 74 of the catch against the bias of the spring 86. The catch 28 defines a pair of blade-engaging bosses 90 that extend through corresponding apertures 92 formed in the blade carrier 26, and are received within respective u-shaped apertures 94 formed in a blade 14 to releasably secure the blade to the blade carrier 26.

The blade carrier 26 defines upper and lower bearing surfaces 96 and 98, respectively, and as shown in FIGS. 8–10, the rear portion 36 of the housing defines corresponding upper and lower bearing surfaces 100 and 102, respectively, for slidably contacting the bearing surfaces of the blade carrier upon moving the blade carrier between retracted and extended positions. As shown in FIG. 10, a guide bar 104 is fixedly secured by fasteners 106 (only one shown) to the rear portion 36 of the housing. The guide bar 104 defines an axially elongated slot 108, and the blade carrier 26 is pinned to the slot 108 by a fastener 110 (FIGS. 12 and 13) to secure the blade carrier to the housing 20 and guide the longitudinal movement thereof.

As shown in FIG. 13, a coil spring 112 is coupled between the actuator 24 and catch 28 to bias the actuator away from the catch and outwardly of the housing 20. The coil spring 112 is seated within the lug 74 of the catch and received over the actuator shaft 72 between a first boss 114 formed at approximately one end of the shaft 72, and a retaining clip 116 connected to an annular groove 118 formed at the other end of the shaft 72. As shown typically in FIGS. 11 and 12, the coil spring 112 urges the first boss 114 of the actuator 24 away from the catch to, in turn, urge the actuator 24 out of the housing 20. The retaining clip 116 engages the lower end of the lug 74 to secure the actuator 24 to the catch 28 and prevent further outward movement of the actuator relative to the catch.

As shown in FIGS. 1 and 2, the housing 20 defines an elongated actuator slot 120 formed between the first and second housing portions 30 and 32, respectively, for receiving the actuator 24 and permitting the actuator to move therethrough between retracted and extended positions. As shown in FIGS. 8–10, the first and second housing portions 30 and 32, respectively, each define a series of approximately rectangular recesses 122 axially spaced relative to each other along the elongated slot 120 for receiving therein a correspondingly shaped second boss 124 formed on the actuator 24 between the first boss 114 and button 70. As shown typically in FIG. 8, the coil spring 112 (FIG. 13) urges the second boss 124 of the actuator upwardly into a respective recess 122 to fix the longitudinal position of the actuator and blade carrier, and thus the longitudinal position of the blade 14 seated on the blade carrier, within the housing. As shown in FIG. 8, the housing 20 defines four recesses 122, and thus four discrete positions of the actuator and blade carrier within the housing. In the illustrated embodiment of the present invention, when the actuator 24 is located in the innermost position, the blade 14 seated on the blade carrier 26 is retracted within the housing. When the actuator 24 is located in any of the other three positions, the cutting edge of the blade 14 is exposed through the blade aperture 38 of the housing. Each of these three positions defines a different degree of exposure of the blade 14 through the blade aperture 38, wherein the innermost position defines the least degree of exposure of the blade, and the outermost position defines the greatest degree of exposure of the blade. The actuator 24 is moved through the slot 20 by engaging the button 70 with a finger to depress the actuator downwardly and, in turn, release the second boss 124 from the respective recess 122 of the housing. Then, with the actuator depressed within the slot 120, the user moves the actuator 24 either backwards or forwards within the slot to the desired position. The user then releases the actuator 24 in the desired position, and the spring 112 urges the second boss 114 into the corresponding recess 122 to secure the blade carrier and blade in place. As may be recognized by those of ordinary skill in the pertinent art based on the teachings herein, the utility knives of the present invention may define any desired number of different extended and/or retracted positions of the blade.

As shown typically in FIGS. 1 and 2, the actuator slot 120 defines a laterally expanded portion formed by a cut-out or laterally extending recess 126 in the first housing portion 30, that is aligned with the actuator 24 when located in the fully-extended position. The cut-out 126 permits the actuator 24 to be pivoted laterally when located in the fully-extended position to, in turn, pivot the catch 28 to release the blade 14. As may be recognized by those of ordinary skill in the pertinent art based on the teachings herein, although the pivot point of the actuator 24 is illustrated as being the outermost position of the blade 14, the pivot point may be located at any of numerous other positions of the blade (including both cutting and non-cutting positions of the blade), and/or the knife may define more than one pivot point or actuator location for releasing the blade. The button 70 defines a first manually engagable surface 128 formed on an upper side of the button for moving the actuator 24 axially through the slot 120 between retracted and extended positions. A second manually engagable surface 130 is located on the side wall of the button opposite the cut-out 126 and first body portion 30 of the housing 20 for moving the actuator laterally to, in turn, move the catch 28 to release a blade 14. The actuator 24 further defines a visible marking 132 on the second manually-engagable surface 130 for identifying a location at which force may be applied to laterally pivot the actuator and, in turn, move the catch to release the blade. As can be seen, the first manually-engagable surface 128 defines an inner, substantially convex portion, and outer relatively flat portions located on either side of the inner convex portion. This surface contour facilitates depressing the button 70 with a finger against the force of the spring 112 (FIG. 13) and moving the button backwards and forwards within the slot 120 to, in turn, move the blade carrier 26 and blade 14 between retracted and extended positions. In addition, the second manually-engagable surface 130 defines a substantially concave surface contour to facilitate manually engaging the surface 130 with a finger, and laterally moving the actuator into the cut-out 126 to, in turn, pivotally move the catch 28 to release a blade 14 from the blade carrier 26.

As shown in FIGS. 8–10, the spare blade holder assembly 16 includes a mount 134 formed on the first housing portion 30 and extending laterally therefrom. The mount 134 defines an elongated slot 136 and a first protuberance 138 extending laterally into the slot. As shown best in FIG. 14, the spare blade holder assembly 16 further comprises a sheet material spare blade holder 140 defining a mounting portion 142, a blade support portion 144, a first fold 146 formed between the mounting and blade support portions, a blade retaining portion 148 overlying the blade support portion 144 and biased toward the blade support portion, and a second fold 150 formed between the blade support and blade retaining portions. A second protuberance 152 is formed on the opposite side of the mounting portion 142 relative to the blade support portion 144 and projects laterally outwardly therefrom. As shown in FIGS. 8–10, the mounting portion 142 of the sheet material spare blade holder 140 is received within the elongated slot 136 of the mount 134 such that the second protuberance 152 is snapped in place below the first protuberance 138 to secure the sheet material spare blade holder 140 in place. As can be seen, when the mounting portion 142 is received within the mount 134, the mounting portion is oriented substantially perpendicular to the plane of the blade supporting surface 73 of the blade carrier 26 and of a blade 14 seated thereon. As shown typically in FIGS. 8–10, a plurality of spare blades 18 are slidably receivable between the blade support portion 144 and blade retaining portion 148. In the illustrated embodiment, the sheet material spare blade holder 140 is formed of sheet metal, such as a spring steel, and the blade retaining portion 148 is biased inwardly toward the blade support portion 144 to secure the spare blades 18 received therebetween. The spare blade holder 140 is formed by cutting, stamping or otherwise forming a piece of flat sheet material, and then pressing or otherwise folding the flat sheet of material into the illustrated form. However, as my be recognized by those of ordinary skill in the pertinent art based on the teachings herein, the spare blade holder 140 may be made of any of numerous different materials in accordance with any of numerous different methods that are currently or later become known. For example, if desired, the spare blade holder 140 may be formed by molding a suitable plastic into the illustrated shape, or into another desired shape.

When the blade carrier 26 is located in the fully-extended position (FIGS. 8–10), the blade 14 may be released by pivoting the second manually-engagable surface 132 of the button 70 away from the blade carrier 26 and within the corresponding cut-out 126 formed in the housing 20. This, in turn, pivotally moves the catch 28 away from the blade carrier 26 and moves the bosses 90 of the catch 28 out of the apertures 94 of the blade. The blade 14 may be removed through the blade aperture 38 in the nose 34 of the housing 20. Then, the same blade 14 may be flipped to present the other side of the cutting edge for use, or a new blade may be installed. In either case, the blade 14 may be inserted through the blade aperture 38 in the nose 34 of the housing 20 and the manually engageable button 70 is simultaneously pivoted to move the bosses 90 of the catch 28 out of the path of the blade. Once the blade 14 is fully inserted, the button 70 is released to allow the torsion spring 86 to bias the bosses 90 of the catch 28 into the corresponding blade apertures 94 to secure the blade 14 to the blade carrier 26.

As shown in FIGS. 8–10, the mechanism 22 for releasably fastening the two portions 30, 32 of the housing 20 includes a slidable member 154 that defines the manually operable button 44 and a catch 156 joined thereto. A clip 158 retains the slidable member 154 to the second housing portion 32. A spring (not shown) is coupled to the slidable member 154 to urge the slidable member inwardly (i.e., towards the pivot pin 40 connecting the first and second housing portions 30, 32 together). The mechanism 22 further includes a latch 160 that projects from the first housing portion 30. The latch 160 defines a shape that is substantially complementary to the shape defined by the catch 156. A coil spring 162 is fixedly secured on one end to the second housing portion 32 adjacent to the slidable member 154 and catch 156. A raised protuberance 164 is formed on the first housing portion 30 opposite the spring 162, and an annular seat 166 extends about the periphery of the protuberance. When the housing is in a closed state, the raised protuberance 164 is received within a central aperture of the spring 162, and the outer surface of the spring is seated against the annular seat 166.

The operation of the mechanism 22 is as follows. The spring (not shown) biases the slidable member 154 toward an engagement position (e.g., toward the rear of the housing 20) wherein the catch 156 engages the complementary latch 160 to fasten the two portions 30, 32 of the housing together and thereby place the housing in the closed state. The button 44 is manually slidable toward a disengagement position (e.g., toward the front of the housing 20), wherein the catch 156 is disengaged from the latch 160 so that the front ends of the two housing portions 30, 32 may be moved apart from one another to place the housing in an open state. The spring 162 mounted on the second housing portion 32 helps separate the two housing portions 30, 32 upon disengagement.

Turning to FIGS. 15–21, another utility knife embodying the present invention is indicated generally by the reference numeral 210. The utility knife 210 is substantially similar to the utility knife 10 described above, and therefore like reference numerals preceded by the numeral "2", or preceded by the numeral "3" instead of the numeral "1", are used to indicate like elements. A primary difference of the utility knife 210 in comparison to the utility knife 10 is that the actuator 224 is rotatably mounted on the blade carrier 226, and is rotatable to move the catch 228 out of engagement with a blade 214 to release the blade from the blade carrier. In addition, the housing 220 does not include a nose formed of a different material, and the spare blade holder 216 is different than the spare blade holder described above.

Figure 19B:
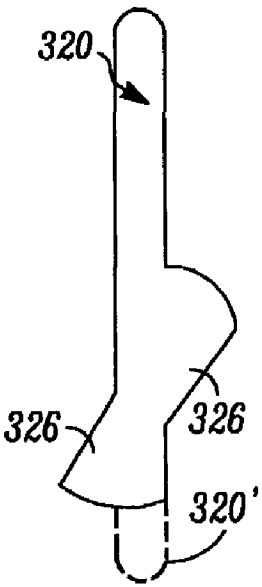
FIG. 19B is a somewhat schematic view of the slot formed within the housing of the utility knife of FIG. 15 for allowing both longitudinal and rotatable movement of the actuator within the housing.
Figure 19A:
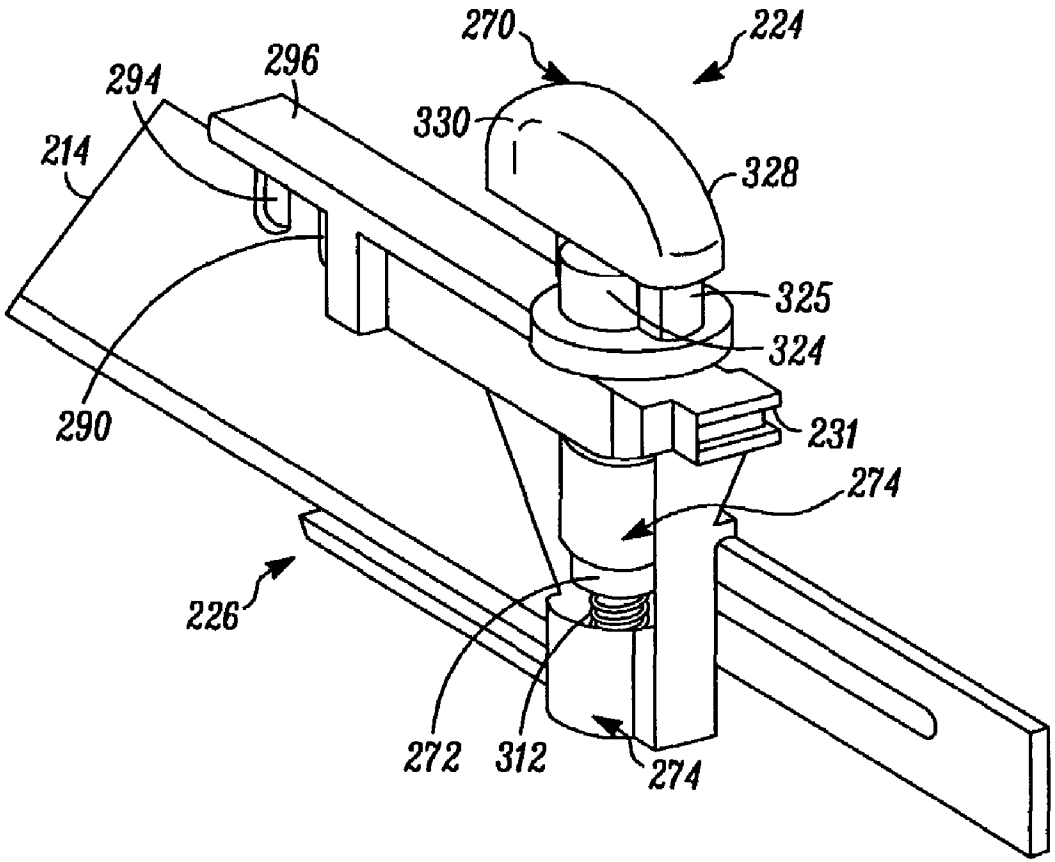
FIG. 19A is an opposite side perspective view of the blade carrier of FIG. 18.
Figure 20:
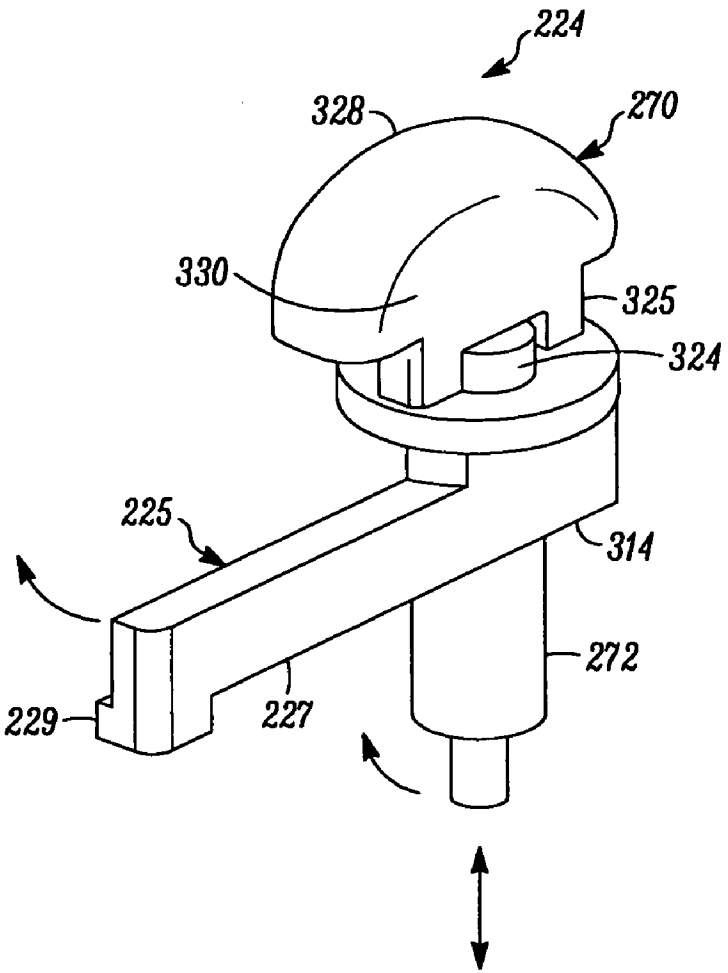
FIG. 20 is a perspective view of the actuator of the utility knife of FIG. 15.
Figure 21:
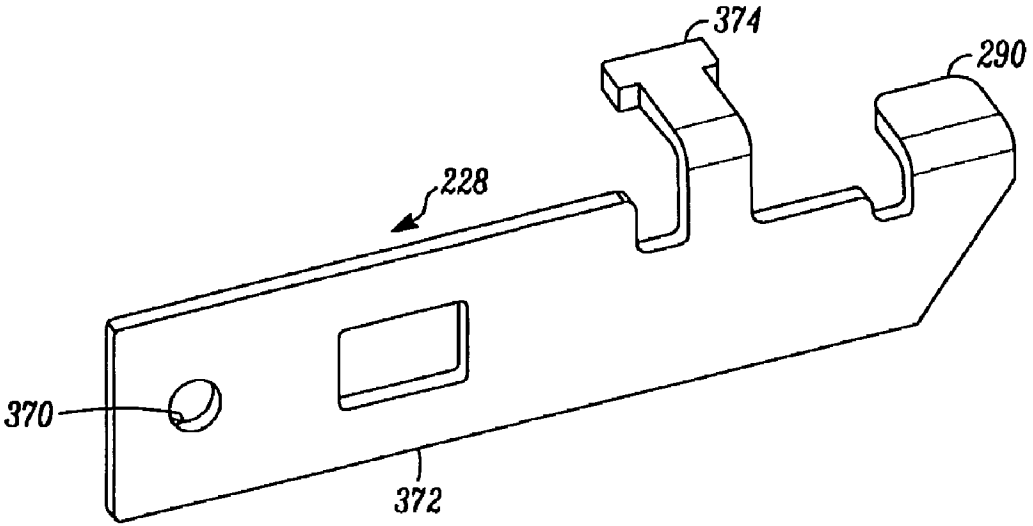
FIG. 21 is a perspective view of the catch of the utility knife of FIG. 15.

As shown in FIGS. 19 and 20, the actuator 224 includes a manually engageable button 270, and a shaft 272 extending downwardly from the button and slidably received within axially spaced lugs 274 formed in the blade carrier 226. A spring 312 is coupled between the shaft 272 of the actuator and the base of the lower lug 274 to bias the actuator outwardly of the housing. The actuator 224 defines a boss 324 that is received within corresponding axially spaced recesses (not shown) formed in the housing 220 under the bias of the spring 312 to prevent relative movement between the blade carrier 226 and housing and thereby fix the longitudinal position of the blade. In order to move the blade between retracted and extended position, the manually engagable button 270 is depressed against the bias of the spring 312 and moved backwards and forwards within the slot 320 of the housing (FIG. 19B). The actuator 224 defines an axially-extending guide portion 325 for guiding movement of the actuator through the housing slot 320.

Figure 18:
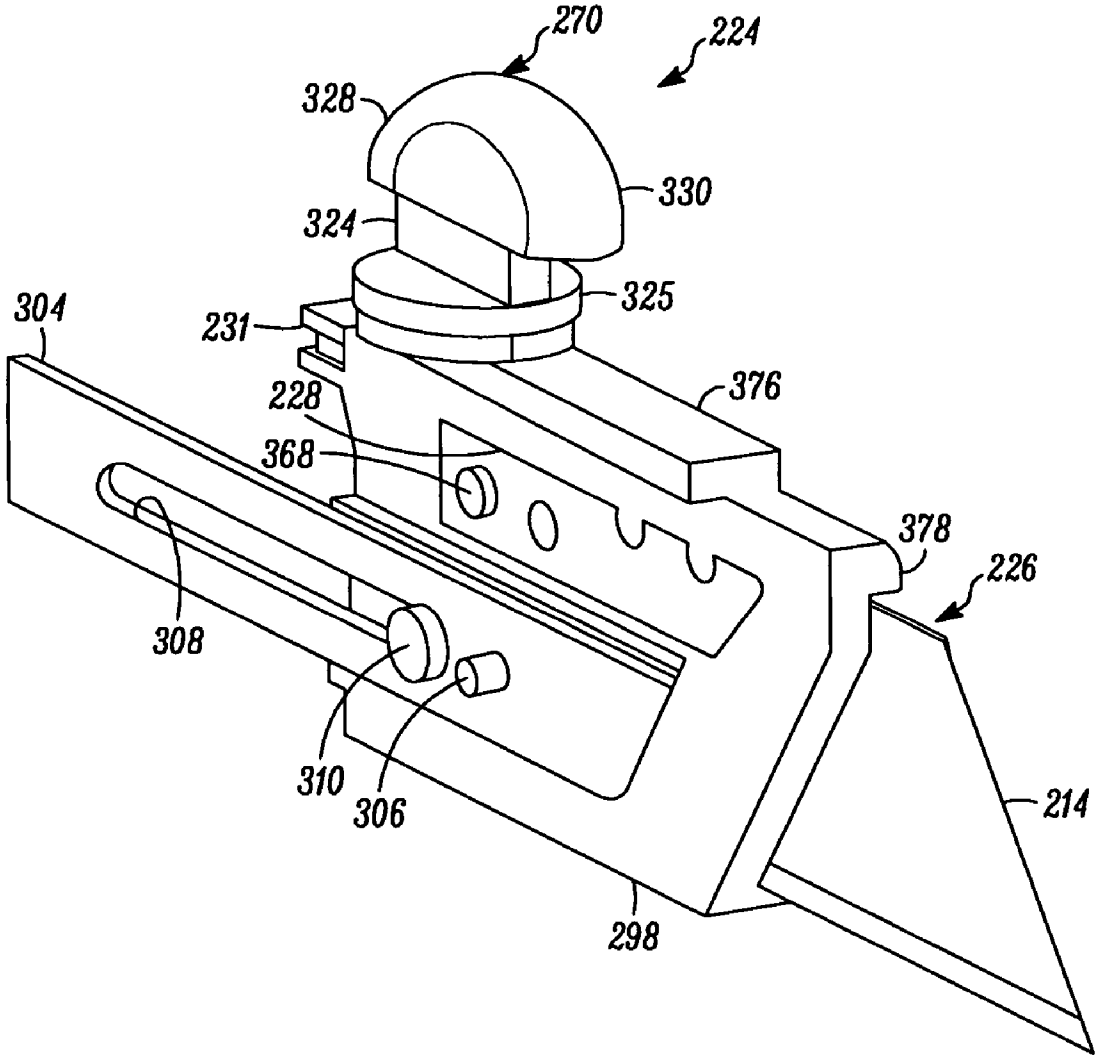
FIG. 18 is a side perspective view of the blade carrier of the utility knife of FIG. 15.

A blade releasing structure 225 extends perpendicularly from the actuator shaft 272. The manually engageable button 270, shaft 272, and blade releasing structure 225 are formed integral with each other as a single molded part. However, as may be recognized by those of ordinary skill in the pertinent art based on the teachings herein, these portions of the blade releasing structure need not be formed integral with each other, and further, can take any of numerous different forms, and can be formed in any of numerous different ways, that are currently or later become known. The blade releasing structure 225 includes an integral arm 227 extending perpendicularly from the shaft 272, and a blade releasing boss 229 formed at the free end of the arm. The spring-biased catch 228 is fixedly secured at one end to the back side of the blade carrier 226 by a fastener 368, such as a rivet. As shown typically in FIG. 21, the spring-biased catch 228 includes on one end an aperture 370 for receiving therethrough the fastener 368, an integral spring arm portion 372, an actuator boss 374, and a blade-engaging boss 290 spaced axially relative to the actuator boss. As shown in FIG. 18, the actuator boss 374 is received through a first aperture 376 extending through the blade carrier 226, and the blade-engaging boss 290 is received through a second aperture 378 extending through the blade carrier 226 and within a respective u-shaped aperture 294 formed in the blade 214 to releasably secure the blade to the blade carrier. The blade carrier 226 is pinned by a fastener 310 to a longitudinally-extending slot 308 formed in a guide bar 304 mounted to the first portion 230 of the housing 220 to secure the blade carrier to the housing and guide the longitudinal movement thereof. As shown in FIGS. 18 and 19, the blade carrier 226 defines an axially-extending recess 231 for receiving therein an axially-extending guide rib or other guide member (not shown) located on the first housing portion 230 to further guide the longitudinal movement of the blade carrier within the housing.

When the blade carrier 226 is located in the fully-extended position, the blade 214 may be released by rotating the manually engageable button 270 slightly (about 3° clockwise when viewed in the direction from the actuator toward the nose of the housing) to, in turn, rotate the guide portion 325 of the actuator within a corresponding cut-out 326 formed in the body (FIG. 19B). This, in turn, causes the boss 229 of the blade release arm 227 to engage the actuator boss 374 of the spring-biased catch 228 and move the catch laterally out of the u-shaped blade aperture 294 to release the blade 214 from the catch. The blade 214 then may be removed through the blade aperture 238 in the nose of the housing 220. Then, the same blade 214 may be flipped to present the other cutting edge for use, or a new blade may be installed. In either case, the blade 214 may be inserted through the blade aperture 238 in the nose of the housing and the manually engageable button 270 is simultaneously pivoted to move the spring-biased catch 228 out of the path of the blade. Once the blade 214 is fully inserted, the button 270 is released to allow the boss 290 of the spring-biased catch 228 to move laterally into the blade aperture 294 and secure the blade 214 to the blade carrier 226.

As shown in broken lines in FIG. 19B, the slot 320 may include a portion 320' extending beyond the cut-out 326 so that the blade is not released in the fully-extended position. However, as may be recognized by those of ordinary skill in the pertinent art based on the teachings herein, the utility knives of the present invention may define any of numerous different blade positions for releasing the blade and/or for cutting.

Figure 16:
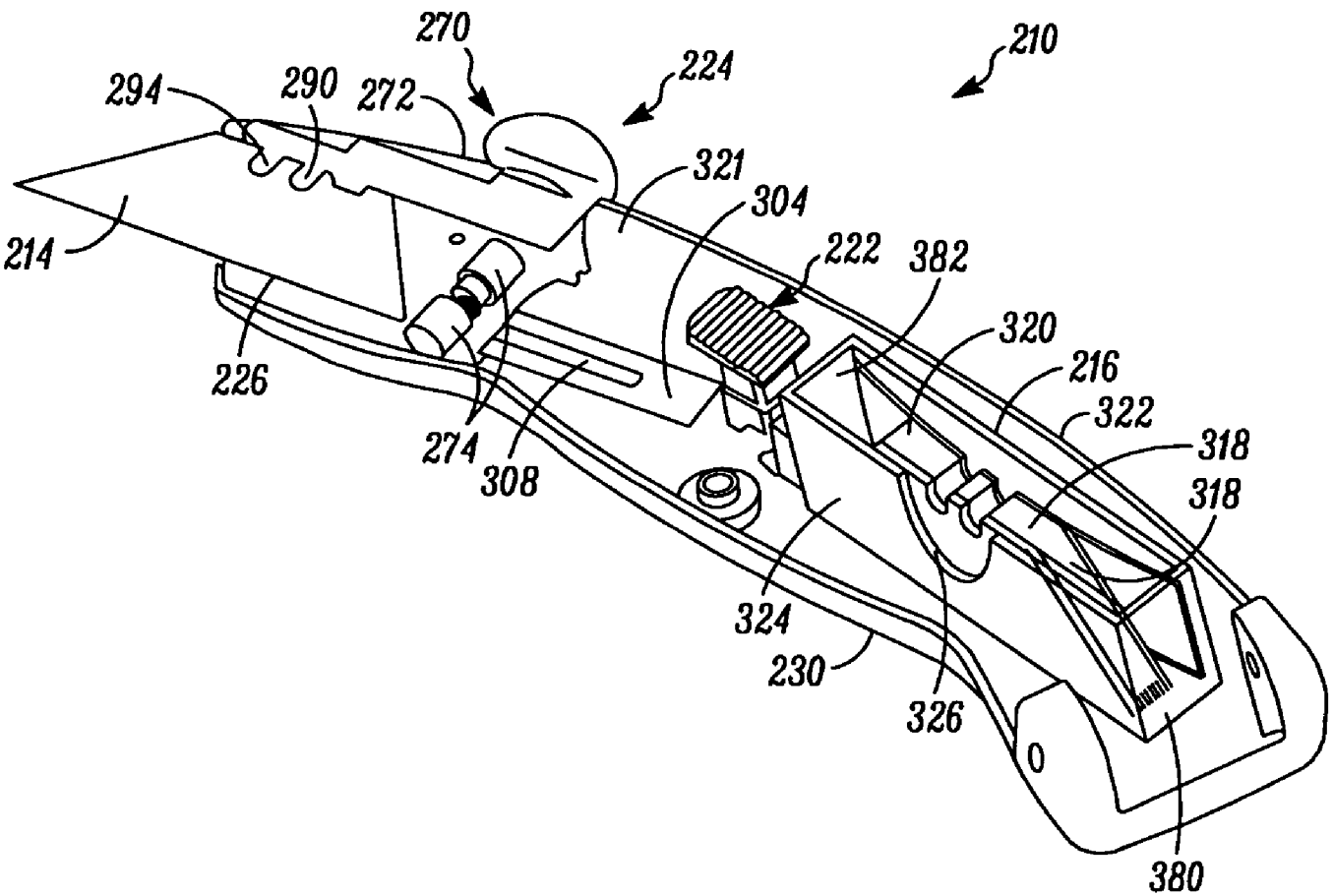
FIG. 16 is a partial, upper perspective view of the utility knife of FIG. 15 showing one side of the housing and the blade carrier and spare blade holder mounted thereon.
Figure 17:
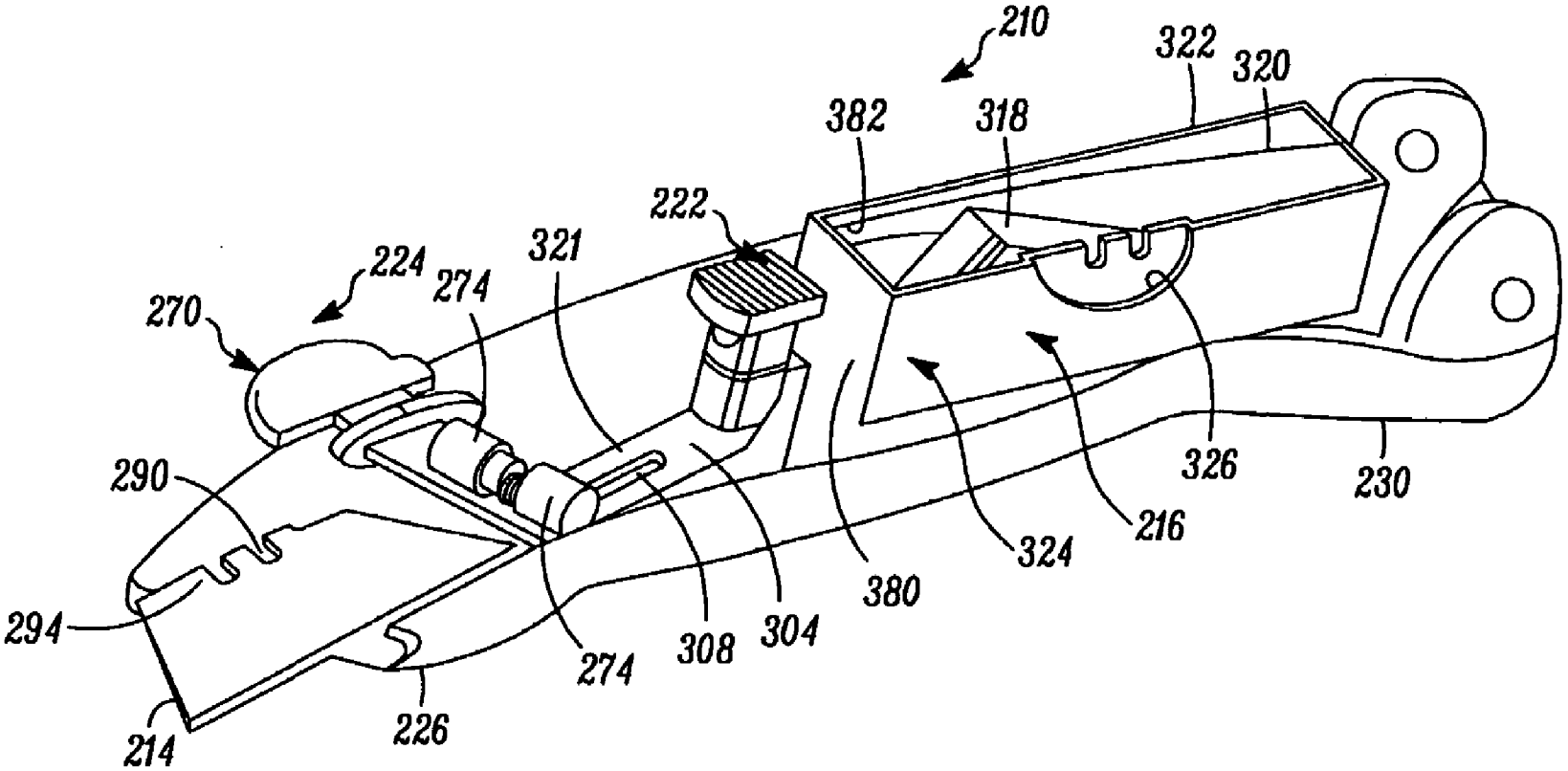
FIG. 17 is partial, side perspective view of the housing, blade carrier and spare blade holder of FIG. 16.

As shown in FIGS. 16 and 17, the spare blade holder 216 includes an approximately rectangular-shaped container defining a closed base 380 fixedly secured to the inner wall of the first housing portion 230, and an open end 382 for receiving therein a plurality of spare blades 318. A leaf spring 320 is seated between a back wall 322 of the spare blade holder and the plurality of blades 318 to bias the blades against a front wall 324 of the holder and thereby secure the blades within the holder. The front wall 324 defines a semi-circular cut-out 326 to facilitate removal of the blades from the holder. As can be seen, the spare blades 318 are oriented substantially perpendicular to the blade 214 mounted on the blade carrier 226, and are contained within the internal cavity 321 when the housing is in a closed state.

If desired, the spare blade holder and other components of the utility knives of the present invention may be the same as, or similar to corresponding components described in the commonly assigned U.S. Provisional Patent Application entitled Utility Knife, filed on Nov. 10, 2003, accorded Ser. No. 60/518,690, and incorporated by reference above.

Figure 22:
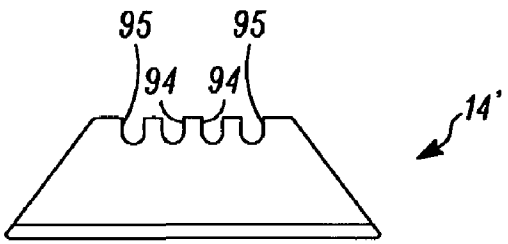
FIG. 22 is a side elevational view of a utility blade that is usable in the utility knives of the present invention and that includes four notches in the upper edge of the blade to provide two cutting positions on the blade carrier for each side of the cutting edge of the blade.

In FIG. 22, an alternative utility blade usable with the utility knives of the present invention is indicated generally by the reference numeral 14'. The primary difference of the utility blade 14' in comparison to the utility blade 14 described above, is that the utility blade 14' defines in its upper edge two inner notches or u-shaped apertures 94 and two outer notches or u-shaped apertures 95. Accordingly, each side of the blade defines two cutting positions, a first cutting position with the blade-engaging bosses 90 received within the two inner notches 94, and a second cutting position with the blade-engaging bosses 90 received within one inner notch 94 and a respective outer notch 95. In the illustrated embodiment, when the blade 14' is located in the first cutting position, about 45% of the cutting edge extends outwardly of the blade aperture 38 and is exposed for cutting in the fully-extended position of the carrier. In the second cutting position, on the other hand, a greater portion of the cutting edge extends outwardly of the blade aperture 38 in comparison to the first cutting position. In the illustrated embodiment, in the second cutting position, about 55% of the cutting edge extends outwardly of the blade aperture 38 and is exposed for cutting in the fully-extended position of the carrier.

If desired, the blades 14 and 14' may be any of the different types of composite utility blades disclosed in the following patent and co-pending patent applications, which are assigned to the Assignee of the present invention and are hereby expressly incorporated by reference as part of the present disclosure: U.S. Pat. No. 6,701,627 issued Mar. 9, 2004, entitled "COMPOSITE UTILITY KNIFE BLADE AND METHOD OF MAKING SUCH A BLADE"; U.S. patent application Ser. No. 10/202,703 filed Jul. 24, 2002, entitled "COMPOSITE UTILITY KNIFE BLADE AND METHOD OF MAKING SUCH A BLADE"; and U.S. patent application Ser. No. 10/793,593 filed Mar. 4, 2004, entitled "COMPOSITE UTILITY BLADE AND METHOD OF MAKING SUCH A BLADE". One advantage of such composite utility blades is that they are bendable and virtually shatter-proof. As a result, such blades are particularly well suited to defining four notches 94, 95, as opposed to only two notches as in conventional utility blades, because when located in the fully extended, second cutting position, such blades can be subjected to relatively high lateral forces and bending without shattering or otherwise breaking.

In one or more embodiments of the utility knives of the present invention, the nose 34 may be physical vapor deposition ("PVD") coated to further improve its durability, wear resistance and corrosion resistance, and if desired, to provide an aesthetically pleasing appearance. In one such embodiment, the nose 34 is PVD coated with titanium nitride ("TiN") in a manner known to those of ordinary skill in the pertinent art prior to assembling the nose 34 to the rear housing portion 36 as described above. One advantage of the TiN coated nose portion is that it provides greater wear resistance and corrosion resistance in comparison to a nose portion without any such coating. As indicated above, the nose 34 is located adjacent to the blade 14, and therefore frictionally engages during use the work pieces or other surfaces being cut. Accordingly, the nose portions of utility knives tend to wear more rapidly, and/or tend to be subject to more corrosive agents, than other portions of such knives. Accordingly, another advantage of the PVD coated nose portion is that the coating preferably is applied only to the portion or part of the utility knife most subject to wear or corrosion, which in the illustrated embodiment is the nose portion. Preferably, the nose 34 is PVD coated prior to assembling the nose to the rear housing portion 36. As a result, the amount of coating required is minimized, and the coating process is simplified in comparison to coating the nose 34 only after it is assembled to the rear housing portion 36.

As may be recognized by those of ordinary skill in the pertinent art based on the teachings herein, numerous changes may be made to the above-described and other embodiments of the present invention without departing from the scope of the invention as defined in the appended claims. For example, numerous different types of coatings may be employed to coat the nose or other portions of the utility knife, including carbide coatings, nitride coatings, and combinations thereof. Coatings intended to reduce the rate of wear of the nose portion may comprise, for example, any suitable material(s) including but not limited to titanium nitride (TiN), chrome nitride (CrN), titanium carbide (TiC), ceramic(s), titanium carbonitride (TiCN), Aluminum Titanium Nitride (AlTiN), Aluminum Titanium Carbonitride (AlTiCN), Zirconium Nitride (ZrN), Zirconium Carbonitride (ZrCN), and/or combinations thereof. In one exemplary embodiment, the nose portion is coated with an inner layer of AlTiN and an outer layer of TiN for a gold-colored appearance. The AlTiN coatings are applied to the nose portion in a thickness within the range of about 3 micrometers to about 5 micrometers. In the embodiment employing an inner coating of AlTiN and out outer coating of TiN, the outer coater is thinner than the inner coating. In one such embodiment, the AlTiN coating is applied so as to provide a gradient (linear or otherwise) such that the concentration of aluminum increases from a first lesser concentration at the substrate surface to a second greater concentration at the outer surface of the coating. One advantage of this configuration is that the higher concentration of titanium at the substrate/coating interface facilitates adhesion of the coating to the substrate.

As indicated above, the coating(s) may be provided using physical vapor deposition (PVD). Physical vapor deposition may be carried out in any suitable manner including but not limited to using cathodic arc deposition, thermal/electron beam deposition, and/or sputter deposition. However, coatings also may be provided by other methods. Indeed, coatings may be provided using any suitable manner including but not limited to painting, spraying, brushing, dipping, plating (electroplating or electro-less plating), physical and/or chemical vapor deposition, or any combination thereof. Powder coatings and e-coatings, and/or combinations of any of the above, also may be employed.

Although the housing is shown having two separate portions that are pivotally connected to one another, this is not a requirement. For example, the housing may be formed of any number of separate portions. Such portions may be connected in any manner, completely separable from one another, and/or combinations thereof.

As stated above, there is no requirement for, or against, all portions of the housing being formed of the same type of material. Thus, for example, one portion of the housing may be made of a material that is more wear resistant than another portion, for example, in order to increase the durability of some portion(s).

Although shown attached to the blade carrier which is, in turn, attached to the housing, the mechanism for releasably retaining the blade need not be retained to the housing and/or prevented from becoming separated from the housing when the housing is in the opened state.

Furthermore, although the blades illustrated herein define a trapezoidal shape, each of the various aspects of the present invention may be used in association with blade(s) of any shape and type, for example, but not limited to, blades that define rectangular or parallelogram shapes, blades with squared, rounded or oblique cutting corners, and combinations thereof.

In addition, although the notches in the blades are shown as approximately semi-circular, the notches are not limited to such. For example, a notch may take other shapes and/or configurations in the same or other locations on the blade. In addition, although the blades are shown having two notches, a blade may alternatively have one notch, no notches, or more than two notches.

Further, the actuator may be configured in any of numerous different ways, and may move in any of numerous different ways, that are currently or later become known for purposes of moving the blade carrier and blade between retracted and extended positions, and for releasing a blade from the blade carrier.

Thus, while there have been shown and described various embodiments, it will be understood by those skilled in the art that the present invention is not limited to such embodiments, which have been presented by way of example only, and that various changes and modifications may be made without departing from the spirit and scope of the invention. Accordingly, the invention is limited only by the appended claims and equivalents thereto.

What is claimed is:

1. A utility knife comprising:

a housing;

a blade carrier movably mounted in the housing and including a blade supporting surface for supporting a blade, wherein the blade carrier is movable between a retracted position with at least a substantial portion of the blade retracted in the housing, and at least one extended position with at least a portion of the blade extending outwardly of the housing;

a catch pivotally mounted on the blade carrier and movable relative to the blade supporting surface between a first position engageable with the blade located on the blade carrier and substantially preventing relative movement of the blade and the blade carrier, and a second position spaced away from the blade located on the blade carrier and permitting removal of the blade from the blade carrier;

an actuator mounted on the blade carrier, coupled to the catch, and manually engageable to both (i) move the blade carrier between the retracted and extended positions to, in turn, move the blade located on the blade carrier between retracted and extended positions, and (ii) move the catch between the first and second positions to release the blade from the blade carrier; and a stop surface engageable with at least one of the actuator and the catch in the first position.

2. A utility knife as defined in claim 1, wherein the catch is biased toward the first position.

3. A utility knife as defined in claim 2, further comprising a spring biasing the catch toward the first position.

4. A utility knife as defined in claim 3, wherein the spring is a torsion spring.

5. A utility knife as defined in claim 3, wherein the catch is secured to the blade carrier and at least a portion of the catch forms the spring biasing the catch toward the first position.

6. A utility knife as defined in claim 1, wherein the actuator is pivotally mounted on the blade carrier for moving the catch between the first and second positions.

7. A utility knife as defined in claim 6, wherein the actuator includes a shaft coupled to the catch for moving the actuator laterally to, in turn, move the catch.

8. A utility knife as defined in claim 7, further comprising a spring coupled to the actuator for biasing the actuator outwardly of the housing.

9. A utility knife as defined in claim 7, wherein the housing defines an elongated slot, and the actuator is movable through the slot between the retracted and extended positions.

10. A utility knife as defined in claim 9, wherein the slot defines at least one laterally-expanded portion for receiving therein the actuator upon pivoting the actuator.

11. A utility knife as defined in claim 10, wherein the actuator is aligned with the laterally-expanded portion of the slot when the blade carrier is located in a fully-extended position.

12. A utility knife as defined in claim 1, wherein the actuator is rotatably mounted on the blade carrier for moving the catch between the first and second positions.

13. A utility knife as defined in claim 12, wherein the actuator includes a blade-releasing portion extending therefrom and engageable with the catch upon rotating the actuator.

14. A utility knife as defined in claim 13, wherein the housing defines an elongated slot, and the actuator is movable through the slot between the retracted and extended positions.

15. A utility knife as defined in claim 14, wherein the slot defines at least one laterally-expanded portion for receiving therein the actuator upon rotating the actuator to, in turn, move the catch.

16. A utility knife as defined in claim 15, wherein the catch is secured to the blade carrier and at least a portion of the catch forms a spring biasing the catch toward the first position.

17. A utility knife as defined in claim 1, further comprising an axially-elongated surface defining an axially-elongated slot, and a fastener coupled between the blade carrier and the slot for guiding movement of the blade carrier between retracted and extended positions.

18. A utility knife as defined in claim 17, wherein the axially-elongated surface is defined by a bar fixedly secured to an interior surface of the housing and forming therein the axially-elongated slot.

19. A utility knife as defined in claim 18, wherein the blade carrier defines an axially-elongated boss received within the slot for guiding movement of the carrier through the slot.

20. A utility knife as defined in claim 1, wherein the actuator defines a first manually engageable surface for moving the actuator between the retracted and extended positions, and a second manually engageable surface for moving the actuator to, in turn, move the catch.

21. A utility knife as defined in claim 20, wherein the first manually engageable surface is an upper surface of the actuator, and the second manually engageable surface is a side surface of the actuator.

22. A utility knife as defined in claim 21, wherein the first manually engageable surface defines a substantially convex surface, and the second manually engageable surface defines a substantially concave surface.

23. A utility knife as defined in claim 20, wherein the actuator defines a visible marking on the second manually engageable surface for identifying a location at which force can be applied to move the actuator and, in turn, move the catch from the first toward the second position.

24. A utility knife as defined in claim 1, wherein the housing includes a first portion formed of a first material, and a second portion formed of a second material and coupled to the first portion, wherein the second portion defines a blade aperture for receiving the blade therethrough when the blade carrier is located in the extended position, and for removing the blade therethrough when the catch is located in the second position.

25. A utility knife as defined in claim 24, wherein the second material is more wear-resistant than the first material.

26. A utility knife as defined in claim 25, wherein the second material is harder than the first material.

27. A utility knife as defined in claim 24, wherein the housing includes a third portion movable relative to the first portion and coupled thereto, wherein the first, second and third portions cooperate to define an enclosure for the blade carrier and the catch.

28. A utility knife as defined in claim 24, wherein at least one of the first and second portions defines a flange, and the other of the first and second portions defines a recess for receiving the flange to couple the first and second portions.

29. A utility knife as defined in claim 28, wherein at least one of the first and second portions defines an aperture, and the other defines a protuberance received within the aperture for further coupling the first and second portions.

30. A utility knife as defined in claim 29, wherein the protuberance is deformable after being received through the aperture to fixedly connect the first and second portions.

31. A utility knife as defined in claim 1, further comprising a spare blade holder formed of sheet material and defining a mounting portion connectable to the housing for supporting the spare blade holder thereon, a blade support portion, a first fold located between the mounting and blade support portions, a blade retaining portion overlying the blade support portion and biased toward the blade support portion, and a second fold formed between the blade support and blade retaining portions, wherein a plurality of spare blades are slidably receivable between the blade support and blade retaining portions.

32. A utility knife as defined in claim 31, wherein the blades are substantially planar, and the spare blade holder is oriented in the housing such that a blade located in the spare blade holder is oriented transverse to a blade seated on the blade carrier.

33. A utility knife as defined in claim 32, wherein the spare blade holder is oriented in the housing such that a blade located in the spare blade holder is oriented substantially perpendicular to a blade located on the blade carrier.

34. A utility knife as defined in claim 31, wherein the spare blade holder is formed of spring steel.

35. A utility knife as defined in claim 1, wherein the housing includes two parts defining a cavity receiving the blade carrier, at least one of the parts is movable relative to the other for opening the housing and accessing the blade carrier, and the blade carrier is secured to at least one of the parts to prevent the blade carrier from falling out upon opening the housing.

36. A utility knife as defined in claim 35, further comprising a spare blade holder coupled to one of the parts within the cavity.

37. A utility knife as defined in claim 35, wherein the actuator and the catch are coupled to the carrier to prevent them from falling out upon opening the housing.

38. A utility knife as defined in claim 1, wherein in the blades defines along an edge thereof four notches substantially equally spaced relative to each other, including two inner notches and two outer notches, wherein the two inner notches are engageable with the catch for defining a first respective position of the blade on the blade carrier, and each inner notch and an adjacent outer notch is engageable with the catch for defining a second respective position of the blade on the blade carrier, and in a second cutting position a greater portion of the cutting edge of the blade extends outwardly of the housing than in a first cutting position.

39. A utility knife comprising:

a housing;

a blade carrier movably mounted in the housing and including a blade supporting surface for supporting a blade, wherein the blade carrier is movable between a retracted position with at least a substantial portion of the blade retracted in the housing, and at least one extended position with at least a portion of the blade extending outwardly of the housing;

a catch pivotally mounted on the blade carrier and movable between a first position engageable with the blade located on the blade carrier and substantially preventing relative movement of the blade and blade carrier, and a second position spaced away from the blade located on the blade carrier and permitting removal of the blade from the blade carrier; and an actuator pivotally mounted on the blade carrier and including a shaft coupled to the catch, wherein the actuator is manually engageable to both (i) move the blade carrier between the retracted and extended positions to, in turn, move the blade located on the blade carrier between retracted and extended positions, and (ii) move the catch between the first and second positions to release the blade from the blade carrier, wherein the blade carrier defines a stop surface engageable with at least one of the actuator and the catch in the first position.

40. A utility knife comprising:

a housing;

a blade carrier movably mounted in the housing and including a blade supporting surface for supporting a blade, wherein the blade carrier is movable between a retracted position with at least a substantial portion of the blade retracted in the housing, and at least one extended position with at least a portion of the blade extending outwardly of the housing;

a catch pivotally mounted on the blade carrier and movable between a first position engageable with the blade located on the blade carrier and substantially preventing relative movement of the blade and blade carrier, and a second position spaced away from the blade located on the blade carrier and permitting removal of the blade from the blade carrier; and an actuator pivotally mounted on the blade carrier and including a shaft, wherein the actuator is manually engageable to both (i) move the blade carrier between the retracted and extended positions to, in turn, move the blade located on the blade carrier between retracted and extended positions, and (ii) move the catch between the first and second positions to release the blade from the blade, wherein the catch defines an aperture for receiving therein the shaft of the actuator.

41. A utility knife comprising:

a housing defining a blade aperture;

first means including a stop surface and a blade supporting surface for supporting a blade and for carrying the blade between retracted and extended positions;

second means pivotally mounted on the first means and movable relative to the blade supporting surface between a first position for substantially preventing relative movement of the first means and the blade, and a second position for releasing the blade and permitting removal of the blade through the blade aperture of the housing;

third means mounted on the first means, coupled to the second means, and manually engageable for both (i) moving the first means between retracted and extended positions to, in turn, move the blade mounted on the first means between retracted and extended positions, (ii) and moving the second means in a direction from the first toward the second position to permit removal of the blade through the blade aperture of the housing; and wherein the stop surface is engageable with at least one of the second and third means in the first position.

42. A utility knife as defined in claim 41, wherein the first means is a blade carrier.

43. A utility knife as defined in claim 41, wherein the second means is a catch.

44. A utility knife as defined in claim 41, wherein the third means is an actuator.

45. A utility knife as defined in claim 44, wherein the actuator is at least one of (1) movable laterally for moving the second means between the first and second positions, and (2) rotatable for moving the second means between the first and second positions.

46. A utility knife as defined in claim 44, wherein the actuator is pivotally mounted on the second means.

47. A utility knife as defined in claim 41, wherein the housing defines an elongated slot, and the third means is movable through the slot between the retracted and extended positions.

48. A utility knife as defined in claim 47, wherein the slot defines at least one laterally-expanded portion for receiving therein the third means upon moving the second means.

49. A utility knife as defined in claim 48, wherein the third means is aligned with the laterally-expanded portion of the slot when the first means is located in a fully-extended position.

50. A utility knife as defined in claim 41, further comprising means for visibly marking on the third means a location at which a force can be applied to move the third means and, in turn, move the second means from the first toward the second position.

51. A utility knife as defined in claim 41, wherein the housing includes means for defining the blade aperture and for providing an increased hardness of a surface extending about a periphery of the blade aperture in comparison to the hardness of other surfaces of the housing.

52. A utility knife as defined in claim 51, wherein said means for defining the blade aperture is a nose portion of the housing formed of a first material that is connected to a body portion of the housing formed of a second material, and wherein the first material is harder than the second material.

53. A utility knife as defined in claim 41, further comprising fourth means for holding spare blades.

54. A utility knife as defined in claim 53, wherein the fourth means is formed of sheet material, and includes a fold, a support portion formed on one side of the fold, and a biased retaining portion formed on an opposite side of the fold relative to the support portion and biased toward the support portion, and wherein the biased retaining portion and the support portion define a spare blade receiving space therebetween.

55. A utility knife as defined in claim 41, further comprising fifth means for guiding the first means between retracted and extended positions and for connecting the first means to the housing.

56. A utility knife as defined in claim 55, wherein the fifth means is defined by an elongated member fixedly secured to a side wall of the housing and defining an elongated slot therein, and a fastener slidably connecting the first means to the slot.

57. A method of carrying a blade in a utility knife and releasing a blade therefrom, comprising the following steps:

providing a utility knife having a housing defining a blade aperture, a blade carrier movably mounted in the housing and including a blade support surface for supporting a blade, a stop surface, a catch pivotally mounted on the blade carrier and movable relative to the blade support surface, and an actuator mounted on the blade carrier, coupled to the catch, and operable to move the blade carrier and the catch;

mounting a blade on the blade carrier;

manually engaging and moving the actuator between retracted and extended positions to, in turn, move the blade mounted on the blade carrier between retracted and extended positions;

manually engaging and moving the actuator and, in turn, pivotally moving the catch relative to the blade support surface between a first position substantially preventing relative movement of the blade carrier and the blade, and a second position releasing the blade and permitting the blade to be removed through the blade aperture; and manually releasing the actuator and, in turn, positioning the catch in the first position and engaging at least one of the actuator and the catch with the stop surface.

58. A method as defined in claim 57, further comprising the following steps:

moving the actuator and the blade carrier to the extended position;

with the blade carrier in the extended position, moving the actuator and, in turn, moving the catch from the first to the second position; and with the catch located in the second position, removing the blade from the blade carrier and through the blade aperture.

59. A method as defined in claim 58, further comprising the step of pivoting the actuator laterally to move the catch from the first to the second position.

60. A method as defined in claim 57, further comprising the step of rotating the actuator to move the catch from the first to the second position.

* * * * *